US008500257B2

(12) United States Patent
Morgan et al.

(10) Patent No.: US 8,500,257 B2
(45) **Date of Patent: *Aug. 6, 2013**

(54) INK PRESSURE REGULATOR WITH LIQUID-RETAINING STRUCTURE

(75) Inventors: John Douglas Peter Morgan, Balmain (AU); Miao Wang, Balmain (AU); Kia Silverbrook, Balmain (AU)

(73) Assignee: Zamtec Ltd, Dublin (IE)

( * ) Notice: Subject to any disclaimer, the term of this patent is extended or adjusted under 35 U.S.C. 154(b) by 37 days.

This patent is subject to a terminal disclaimer.

(21) Appl. No.: 13/118,468

(22) Filed: May 30, 2011

(65) Prior Publication Data

US 2011/0227986 A1 Sep. 22, 2011

Related U.S. Application Data

(63) Continuation of application No. 12/910,824, filed on Oct. 24, 2010, now Pat. No. 7,976,143, which is a continuation of application No. 11/872,714, filed on Oct. 16, 2007, now Pat. No. 7,841,684.

(51) Int. Cl.
*B41J 2/175* (2006.01)

(52) U.S. Cl.
USPC ..... 347/85

(58) Field of Classification Search
USPC ..... 347/7, 17, 85, 86, 92
See application file for complete search history.

(56) References Cited

U.S. PATENT DOCUMENTS

| | | | | |
|---|---|---|---|---|
| 4,301,459 | A | 11/1981 | Isayama et al. | |
| 4,412,232 | A | 10/1983 | Weber et al. | |
| 4,968,998 | A | 11/1990 | Allen | |
| 5,363,130 | A | 11/1994 | Cowger et al. | |
| 5,526,030 | A | 6/1996 | Baldwin et al. | |
| 5,760,806 | A | 6/1998 | Oda et al. | |
| 5,841,454 | A | 11/1998 | Hall et al. | |
| 6,000,789 | A | 12/1999 | Takagi et al. | |
| 6,007,193 | A | 12/1999 | Kashimura et al. | |
| 6,186,620 | B1 | 2/2001 | Hsieh et al. | |
| 6,550,900 | B2 * | 4/2003 | Chan et al. | 347/86 |
| 6,692,119 | B2 * | 2/2004 | Yu et al. | 347/86 |
| 6,726,315 | B2 | 4/2004 | Koizumi et al. | |
| 6,783,219 | B2 | 8/2004 | Lui et al. | |
| 6,969,163 | B2 * | 11/2005 | Studer et al. | 347/86 |
| 6,976,753 | B2 | 12/2005 | Kuwabara et al. | |
| 7,255,431 | B2 | 8/2007 | Lui | |
| 7,258,434 | B2 * | 8/2007 | Smith et al. | 347/87 |
| 7,703,900 | B2 | 4/2010 | Morgan et al. | |
| 7,703,901 | B2 | 4/2010 | Morgan et al. | |
| 7,722,170 | B2 | 5/2010 | Morgan et al. | |

(Continued)

FOREIGN PATENT DOCUMENTS

| | | | |
|---|---|---|---|
| GB | 2424621 | A | 10/2006 |

*Primary Examiner* — Anh T. N. Vo
(74) *Attorney, Agent, or Firm* — Cooley LLP

(57) ABSTRACT

An ink pressure regulator for regulating a hydrostatic pressure of ink supplied to an inkjet printhead. The regulator includes an ink chamber having an ink outlet for fluid communication with the printhead via an ink line. A roof of the ink chamber includes: an air inlet; a regulator channel having a first end communicating with the air inlet and a second end communicating with a headspace of the chamber; and a liquid-retaining structure in fluid communication with the regulator channel. The liquid-retaining structure is positioned and configured for capturing ink from the headspace of the ink chamber. The regulator channel is dimensioned to regulate a hydrostatic pressure of the ink supplied to the printhead.

10 Claims, 17 Drawing Sheets

U.S. PATENT DOCUMENTS

| | | | | |
|---|---|---|---|---|
| 7,784,925 | B2 | 8/2010 | Morgan et al. | |
| 7,794,038 | B2 | 9/2010 | Morgan et al. | |
| 7,841,684 | B2 | 11/2010 | Morgan et al. | |
| 7,857,441 | B2 | 12/2010 | Morgan et al. | |
| 7,926,899 | B2 * | 4/2011 | Morgan et al. | 347/17 |
| 7,976,143 | B2 * | 7/2011 | Morgan et al. | 347/86 |
| 2003/0184604 | A1 | 10/2003 | Thielman et al. | |
| 2007/0097187 | A1 | 5/2007 | Lewey et al. | |
| 2007/0103520 | A1 | 5/2007 | Wu | |
| 2010/0201766 | A1 | 8/2010 | Morgan et al. | |
| 2010/0201767 | A1 | 8/2010 | Morgan et al. | |
| 2010/0309267 | A1 | 12/2010 | Morgan et al. | |

* cited by examiner

INK PRESSURE REGULATOR WITH LIQUID-RETAINING STRUCTURE

CROSS REFERENCE TO RELATED APPLICATIONS

This application is a continuation of U.S. application Ser. No. 12/910,824 filed Oct. 24, 2010, now issued U.S. Pat. No. 7,976,143, which is a continuation of U.S. application Ser. No. 11/872,714 filed Oct. 16, 2007, now issued U.S. Pat. No. 7,841,684, all of which are herein incorporated by reference.

Various methods, systems and apparatus relating to the present invention are disclosed in the following US Patents/Patent Applications filed by the applicant or assignee of the present invention:

| | | | | |
|---|---|---|---|---|
| 6,276,850 | 6,520,631 | 6,158,907 | 6,539,180 | 6,270,177 |
| 6,405,055 | 6,628,430 | 6,835,135 | 6,626,529 | 6,981,769 |
| 7,125,338 | 7,125,337 | 7,136,186 | 7,286,260 | 7,145,689 |
| 7,130,075 | 7,081,974 | 7,177,055 | 7,209,257 | 6,443,555 |
| 7,161,715 | 7,154,632 | 7,158,258 | 7,148,993 | 7,075,684 |
| 7,400,346 | 7,385,630 | 7,385,629 | 7,385,628 | 7,460,153 |
| 6,966,659 | 6,988,841 | 7,077,748 | 7,255,646 | 7,070,270 |
| 7,014,307 | 7,158,809 | 7,217,048 | 7,430,067 | 7,341,341 |
| 7,567,221 | 7,548,220 | 7,271,829 | 7,465,109 | 7,431,519 |
| 7,777,856 | 7,469,982 | 11/520,735 | 7,556,564 | 7,556,371 |
| 7,506,943 | 7,695,082 | 7,460,882 | 7,564,580 | 7,215,441 |
| 7,056,040 | 6,942,334 | 7,556,325 | 11/740,265 | 7,461,985 |
| 7,470,021 | 7,572,003 | 7,458,678 | 7,688,351 | 7,654,905 |
| 7,461,934 | 7,726,805 | 11/845,669 | 6,799,853 | 7,237,896 |
| 6,749,301 | 7,740,579 | 7,137,678 | 7,252,379 | 7,144,107 |
| 7,426,050 | 7,690,785 | 7,573,501 | 7,220,068 | 7,270,410 |
| 7,241,005 | 7,108,437 | 7,140,792 | 7,224,274 | 7,463,283 |
| 7,590,545 | 7,349,777 | 7,354,121 | 7,195,325 | 7,229,164 |
| 7,150,523 | 7,154,580 | 6,906,778 | 7,167,158 | 7,128,269 |
| 6,688,528 | 6,986,613 | 6,641,315 | 7,278,702 | 7,625,054 |
| 7,150,524 | 7,155,395 | 6,915,140 | 6,999,206 | 6,795,651 |
| 6,883,910 | 7,118,481 | 7,136,198 | 7,092,130 | 6,786,661 |
| 6,808,325 | 7,448,747 | 7,448,746 | 7,219,990 | 7,591,553 |
| 6,750,901 | 6,476,863 | 6,788,336 | 6,322,181 | 6,597,817 |
| 6,227,648 | 6,727,948 | 6,690,419 | 7,431,281 | 6,619,654 |
| 6,969,145 | 6,679,582 | 7,328,896 | 6,568,670 | 6,866,373 |
| 7,280,247 | 7,008,044 | 6,966,628 | 6,644,781 | 6,969,143 |
| 6,767,076 | 6,834,933 | 6,692,113 | 6,913,344 | 6,727,951 |
| 7,128,395 | 7,036,911 | 7,032,995 | 6,969,151 | 6,955,424 |
| 6,969,162 | 7,456,861 | 7,354,122 | 7,234,797 | 6,986,563 |
| 7,295,211 | 7,701,506 | 7,286,162 | 7,283,159 | 7,077,330 |
| 6,196,541 | 7,303,257 | 7,465,012 | 7,226,144 | 7,461,918 |
| 7,267,428 | 7,401,891 | 7,380,924 | 7,093,929 | 7,690,764 |
| 7,441,870 | 7,629,999 | 7,290,862 | 7,646,403 | 7,591,528 |
| 6,195,150 | 7,581,814 | 7,775,639 | 7,900,846 | 7,914,120 |
| 6,362,868 | 6,831,681 | 6,431,669 | 6,362,869 | 6,472,052 |
| 6,356,715 | 6,894,694 | 6,636,216 | 6,366,693 | 6,329,990 |
| 6,459,495 | 6,137,500 | 6,690,416 | 7,050,143 | 6,398,328 |
| 7,110,024 | 6,431,704 | 6,879,341 | 6,415,054 | 6,665,454 |
| 6,542,645 | 6,486,886 | 6,381,361 | 6,317,192 | 6,850,274 |
| 6,646,757 | 6,624,848 | 6,357,135 | 6,271,931 | 6,353,772 |
| 6,106,147 | 6,665,008 | 6,304,291 | 6,305,770 | 6,289,262 |
| 6,315,200 | 6,217,165 | 6,496,654 | 6,859,225 | 6,924,835 |
| 6,647,369 | 6,943,830 | 7,535,582 | 7,021,745 | 6,712,453 |
| 6,460,971 | 6,428,147 | 6,416,170 | 6,402,300 | 6,464,340 |
| 6,612,687 | 6,412,912 | 6,447,099 | 6,837,567 | 6,505,913 |
| 7,128,845 | 6,733,684 | 7,249,108 | 6,566,858 | 6,331,946 |
| 6,246,970 | 6,442,525 | 7,346,586 | 7,685,423 | 6,374,354 |
| 7,246,098 | 6,816,968 | 6,757,832 | 6,334,190 | 6,745,331 |
| 7,249,109 | 7,197,642 | 7,093,139 | 7,509,292 | 7,685,424 |
| 7,743,262 | 7,210,038 | 7,401,223 | 7,702,926 | 7,716,098 |
| 7,757,084 | 7,747,541 | 7,657,488 | 7,119,836 | 7,283,162 |
| 7,286,169 | 7,724,282 | 7,170,652 | 6,967,750 | 6,995,876 |
| 7,099,051 | 7,172,191 | 7,243,916 | 7,222,845 | 7,559,472 |
| 7,285,227 | 7,063,940 | 7,453,586 | 7,193,734 | 7,086,724 |
| 7,090,337 | 7,278,723 | 7,140,717 | 7,558,476 | 7,773,245 |
| 7,256,824 | 7,140,726 | 7,156,512 | 7,186,499 | 7,461,924 |
| 7,525,687 | 7,357,497 | 7,530,665 | 7,404,633 | 6,750,944 |
| 7,468,810 | 7,291,447 | 7,556,257 | 7,533,877 | 7,847,836 |
| 7,665,834 | 11/869,710 | 7,468,140 | 7,633,535 | 6,985,207 |

-continued

| | | | | |
|---|---|---|---|---|
| 6,773,874 | 6,650,836 | 7,324,142 | 7,705,891 | 7,250,975 |
| 7,295,343 | 6,880,929 | 7,236,188 | 7,236,187 | 7,155,394 |
| 7,557,829 | 7,609,411 | 7,055,927 | 6,986,562 | 7,052,103 |
| 7,312,845 | 7,492,490 | 10/656,791 | 7,375,746 | 7,602,423 |
| 7,289,142 | 7,095,533 | 6,914,686 | 6,896,252 | 6,820,871 |
| 6,834,851 | 6,848,686 | 6,830,246 | 6,851,671 | 7,460,152 |
| 7,092,011 | 7,187,404 | 7,483,050 | 6,878,299 | 6,929,348 |
| 6,921,154 | 7,453,492 | 6,913,346 | 7,576,795 | 7,576,794 |
| 7,385,639 | 7,557,853 | 7,714,889 | 7,593,058 | 7,246,897 |
| 7,077,515 | 7,551,202 | 7,808,610 | 7,747,154 | 6,913,875 |
| 7,021,758 | 7,033,017 | 7,161,709 | 7,099,033 | 7,147,294 |
| 7,156,494 | 7,360,872 | 7,434,915 | 7,032,998 | 7,044,585 |
| 7,296,867 | 6,994,424 | 7,384,134 | 7,258,435 | 7,097,263 |
| 7,001,012 | 7,004,568 | 7,040,738 | 7,188,933 | 7,027,080 |
| 7,025,446 | 6,991,321 | 7,131,715 | 7,261,392 | 7,207,647 |
| 7,182,435 | 7,097,285 | 7,331,646 | 7,097,284 | 7,083,264 |
| 7,147,304 | 7,232,203 | 7,156,498 | 7,201,471 | 7,465,023 |
| 7,549,728 | 7,517,057 | 7,210,764 | 7,381,342 | 7,520,593 |
| 7,465,026 | 7,524,029 | 7,407,265 | 7,581,816 | 7,618,110 |
| 6,710,457 | 6,775,906 | 6,507,099 | 7,221,043 | 7,107,674 |
| 7,154,172 | 7,402,894 | 7,247,941 | 7,402,896 | 7,307,354 |
| 6,530,339 | 6,631,897 | 6,851,667 | 6,830,243 | 6,860,479 |
| 6,997,452 | 7,000,913 | 7,204,482 | 7,398,967 | 7,793,926 |
| 7,401,989 | 6,238,044 | 6,425,661 | 7,364,256 | 7,258,417 |
| 7,293,853 | 7,328,968 | 7,270,395 | 7,461,916 | 7,510,264 |
| 7,334,864 | 7,255,419 | 7,284,819 | 7,229,148 | 7,258,416 |
| 7,273,263 | 7,270,393 | 6,984,017 | 7,347,526 | 7,357,477 |
| 7,156,497 | 7,726,778 | 7,780,261 | 7,562,960 | 7,775,625 |
| 7,524,017 | 11/853,814 | 11/853,786 | 11/856,694 | 7,465,015 |
| 7,364,255 | 7,357,476 | 7,758,148 | 7,284,820 | 7,341,328 |
| 7,246,875 | 7,322,669 | 7,878,618 | 11/853,777 | 7,445,311 |
| 7,452,052 | 7,455,383 | 7,448,724 | 7,441,864 | 7,637,588 |
| 7,648,222 | 7,669,958 | 7,607,755 | 7,699,433 | 7,658,463 |
| 6,431,777 | 6,334,664 | 6,447,113 | 7,239,407 | 6,398,359 |
| 6,652,089 | 6,652,090 | 7,057,759 | 6,631,986 | 7,187,470 |
| 7,280,235 | 7,414,749 | 7,808,670 | 7,744,208 | 6,471,331 |
| 6,676,250 | 6,347,864 | 6,439,704 | 6,425,700 | 6,588,952 |
| 6,626,515 | 6,722,758 | 6,871,937 | 7,794,066 | 7,344,226 |
| 7,328,976 | 7,794,613 | 7,669,967 | 11/685,090 | 11/740,925 |
| 7,605,009 | 7,568,787 | 7,249,942 | 7,206,654 | 7,162,324 |
| 7,162,325 | 7,231,275 | 7,146,236 | 7,278,847 | 10/753,499 |
| 6,997,698 | 7,220,112 | 7,231,276 | 7,373,214 | 7,220,115 |
| 7,195,475 | 7,144,242 | 7,306,323 | 7,306,319 | 7,467,837 |
| 7,322,674 | 7,513,596 | 7,416,276 | 7,833,001 | 7,467,025 |
| 7,556,329 | 7,797,071 | 7,706,909 | 7,766,641 | 11/853,755 |
| 6,786,420 | 6,827,282 | 6,948,661 | 7,073,713 | 7,475,825 |
| 7,093,762 | 7,083,108 | 7,222,799 | 7,201,319 | 7,524,045 |
| 7,703,910 | 11/518,238 | 11/518,280 | 7,663,784 | 11/518,242 |
| 7,032,899 | 6,854,724 | 7,331,651 | 7,334,870 | 7,334,875 |
| 7,416,283 | 7,438,386 | 7,461,921 | 6,350,023 | 6,318,849 |
| 6,592,207 | 6,439,699 | 6,312,114 | 7,506,958 | 7,472,981 |
| 7,448,722 | 7,575,297 | 7,438,381 | 7,441,863 | 7,438,382 |
| 7,425,051 | 7,399,057 | 7,695,097 | 7,686,419 | 7,753,472 |
| 7,448,720 | 7,448,723 | 7,445,310 | 7,399,054 | 7,425,049 |
| 7,367,648 | 7,370,936 | 7,401,886 | 7,506,952 | 7,401,887 |
| 7,384,119 | 7,401,888 | 7,387,358 | 7,413,281 | 7,530,663 |
| 7,467,846 | 7,669,957 | 7,771,028 | 7,758,174 | 7,695,123 |
| 7,798,600 | 7,604,334 | 7,857,435 | 7,708,375 | 7,695,093 |
| 7,695,098 | 7,722,156 | 7,703,882 | 7,510,261 | 7,722,153 |
| 7,581,812 | 7,641,304 | 7,753,470 | 7,570,389 | 7,040,823 |
| 7,535,599 | 7,528,987 | 7,661,779 | 10/922,971 | 7,672,012 |
| 7,692,815 | 7,419,259 | 7,125,185 | 7,229,226 | 7,364,378 |
| 7,465,019 | 7,243,835 | 7,832,626 | 7,703,693 | 10/815,638 |
| 7,251,050 | 10/815,642 | 7,097,094 | 7,137,549 | 7,156,292 |
| 7,427,015 | 10/815,635 | 7,357,323 | 7,654,454 | 7,137,566 |
| 7,131,596 | 7,128,265 | 7,207,485 | 7,197,374 | 7,175,089 |
| 7,819,323 | 7,537,160 | 7,178,719 | 7,506,808 | 7,207,483 |
| 7,296,737 | 7,270,266 | 7,314,181 | 7,874,494 | 7,806,342 |
| 7,856,554 | 11/488,165 | 7,899,708 | 7,267,273 | 7,383,991 |
| 7,383,984 | 7,605,940 | 7,128,270 | 7,784,681 | 7,677,445 |
| 7,506,168 | 7,441,712 | 7,663,789 | 7,681,800 | 7,461,778 |
| 11/863,257 | 7,854,386 | 7,905,401 | 11/041,626 | 7,537,157 |
| 7,801,742 | 7,395,963 | 11/863,269 | 7,637,419 | 7,676,382 |
| 7,464,879 | 7,457,961 | 7,739,509 | 7,467,300 | 7,467,299 |
| 7,565,542 | 11/863,263 | 7,469,819 | 7,484,101 | 7,472,278 |
| 7,467,301 | 7,457,007 | 7,150,398 | 7,159,777 | 7,450,273 |
| 7,188,769 | 7,097,106 | 7,070,110 | 7,243,849 | 7,314,177 |
| 7,469,836 | 7,568,629 | 6,227,652 | 6,213,588 | 6,213,589 |
| 6,231,163 | 6,247,795 | 6,394,581 | 6,244,691 | 6,257,704 |
| 6,416,168 | 6,220,694 | 6,257,705 | 6,247,794 | 6,234,610 |

-continued

| | | | | |
|---|---|---|---|---|
| 6,247,793 | 6,264,306 | 6,241,342 | 6,247,792 | 6,264,307 |
| 6,254,220 | 6,234,611 | 6,302,528 | 6,283,582 | 6,239,821 |
| 6,338,547 | 6,247,796 | 6,557,977 | 6,390,603 | 6,362,843 |
| 6,293,653 | 6,312,107 | 6,227,653 | 6,234,609 | 6,238,040 |
| 6,188,415 | 6,227,654 | 6,209,989 | 6,247,791 | 6,336,710 |
| 6,217,153 | 6,416,167 | 6,243,113 | 6,283,581 | 6,247,790 |
| 6,260,953 | 6,267,469 | 6,588,882 | 6,742,873 | 6,918,655 |
| 6,547,371 | 6,938,989 | 6,598,964 | 6,923,526 | 6,273,544 |
| 6,309,048 | 6,420,196 | 6,443,558 | 6,439,689 | 6,378,989 |
| 6,848,181 | 6,634,735 | 6,299,289 | 6,299,290 | 6,425,654 |
| 6,902,255 | 6,623,101 | 6,406,129 | 6,505,916 | 6,457,809 |
| 6,550,895 | 6,457,812 | 7,152,962 | 6,428,133 | 7,216,956 |
| 7,080,895 | 7,442,317 | 7,182,437 | 7,357,485 | 7,387,368 |
| 11/607,976 | 7,618,124 | 7,654,641 | 7,794,056 | 7,611,225 |
| 7,794,055 | 7,748,827 | 7,735,970 | 7,637,582 | 7,419,247 |
| 7,384,131 | 7,901,046 | 6,224,780 | 6,235,212 | 6,280,643 |
| 6,284,147 | 6,214,244 | 6,071,750 | 6,267,905 | 6,251,298 |
| 6,258,285 | 6,225,138 | 6,241,904 | 6,299,786 | 6,866,789 |
| 6,231,773 | 6,190,931 | 6,248,249 | 6,290,862 | 6,241,906 |
| 6,565,762 | 6,241,905 | 6,451,216 | 6,231,772 | 6,274,056 |
| 6,290,861 | 6,248,248 | 6,306,671 | 6,331,258 | 6,110,754 |
| 6,294,101 | 6,416,679 | 6,264,849 | 6,254,793 | 6,245,246 |
| 6,855,264 | 6,235,211 | 6,491,833 | 6,264,850 | 6,258,284 |
| 6,312,615 | 6,228,668 | 6,180,427 | 6,171,875 | 6,267,904 |
| 6,245,247 | 6,315,914 | 7,169,316 | 6,526,658 | 7,210,767 |
| 7,390,421 | 7,547,095 | 6,665,094 | 6,450,605 | 6,512,596 |
| 6,654,144 | 7,125,090 | 6,687,022 | 7,072,076 | 7,092,125 |
| 7,215,443 | 7,136,195 | 7,077,494 | 6,877,834 | 6,969,139 |
| 7,469,983 | 7,283,280 | 6,912,067 | 7,277,205 | 7,154,637 |
| 7,591,522 | 7,070,251 | 6,851,782 | 6,843,545 | 7,079,286 |
| 7,064,867 | 7,065,247 | 7,027,177 | 7,218,415 | 7,064,873 |
| 6,954,276 | 7,061,644 | 7,092,127 | 7,059,695 | 7,537,297 |
| 7,177,052 | 7,270,394 | 7,463,373 | 7,188,921 | 7,187,469 |
| 7,196,820 | 7,429,092 | 7,283,281 | 7,251,051 | 7,245,399 |
| 7,413,273 | 7,372,598 | 7,382,488 | 7,365,874 | 7,349,125 |
| 7,336,397 | 11/834,637 | 7,456,996 | 7,571,541 | 7,736,458 |
| 7,776,175 | 7,416,629 | 7,469,987 | 6,231,148 | 6,293,658 |
| 6,614,560 | 6,238,033 | 6,312,070 | 6,238,111 | 6,378,970 |
| 6,196,739 | 6,270,182 | 6,152,619 | 7,006,143 | 6,876,394 |
| 6,738,096 | 6,970,186 | 6,287,028 | 6,412,993 | 7,832,817 |
| 7,466,341 | 7,477,287 | 11/672,878 | 7,204,941 | 7,282,164 |
| 7,465,342 | 7,785,502 | 7,278,727 | 7,417,141 | 7,452,989 |
| 7,367,665 | 7,138,391 | 7,153,956 | 7,423,145 | 7,456,277 |
| 7,550,585 | 7,122,076 | 7,148,345 | 7,470,315 | 7,572,327 |
| 7,658,792 | 7,709,633 | 7,837,775 | 11/583,942 | 7,559,983 |
| 7,671,194 | 7,825,262 | 7,772,409 | 7,699,920 | 7,750,147 |
| 7,416,280 | 7,252,366 | 7,488,051 | 7,360,865 | 7,275,811 |
| 7,628,468 | 7,334,874 | 7,393,083 | 7,475,965 | 7,578,582 |
| 7,591,539 | 7,775,634 | 7,472,984 | 7,753,469 | 7,234,795 |
| 7,401,884 | 7,328,975 | 7,293,855 | 7,410,250 | 7,401,900 |
| 7,527,357 | 7,410,243 | 7,360,871 | 7,661,793 | 7,708,372 |
| 7,147,792 | 7,175,774 | 7,404,625 | 7,350,903 | 7,794,053 |
| 7,631,956 | 7,733,535 | 11/563,684 | 11/482,967 | 11/482,966 |
| 11/482,988 | 7,681,000 | 7,438,371 | 7,465,017 | 7,441,862 |
| 7,654,636 | 7,458,659 | 7,455,376 | 7,841,713 | 7,877,111 |
| 7,874,659 | 7,735,993 | 11/124,198 | 7,284,921 | 7,407,257 |
| 7,470,019 | 7,645,022 | 7,392,950 | 7,843,484 | 7,360,880 |
| 7,517,046 | 7,236,271 | 11/124,174 | 7,753,517 | 7,824,031 |
| 7,465,047 | 7,607,774 | 7,780,288 | 11/124,172 | 7,566,182 |
| 11/124,182 | 7,715,036 | 11/124,181 | 7,697,159 | 7,595,904 |
| 7,726,764 | 7,770,995 | 7,466,993 | 7,370,932 | 7,404,616 |
| 11/124,187 | 7,740,347 | 7,500,268 | 7,558,962 | 7,447,908 |
| 7,792,298 | 7,661,813 | 7,456,994 | 7,431,449 | 7,466,444 |
| 11/124,179 | 7,680,512 | 7,878,645 | 7,562,973 | 7,530,446 |
| 7,628,467 | 7,572,077 | 7,761,090 | 11/228,500 | 7,668,540 |
| 7,738,862 | 7,805,162 | 11/228,531 | 11/228,504 | 7,738,919 |
| 11/228,507 | 7,708,203 | 7,641,115 | 7,697,714 | 7,654,444 |
| 7,831,244 | 7,499,765 | 7,894,703 | 7,756,526 | 7,844,257 |
| 7,558,563 | 11/228,506 | 7,856,225 | 11/228,526 | 7,747,280 |
| 7,742,755 | 7,738,674 | 7,864,360 | 7,506,802 | 7,724,399 |
| 11/228,527 | 7,403,797 | 11/228,520 | 7,646,503 | 7,843,595 |
| 7,672,664 | 7,920,896 | 7,783,323 | 7,843,596 | 7,778,666 |
| 11/228,509 | 7,917,171 | 7,558,599 | 7,855,805 | 7,920,854 |
| 7,880,911 | 7,438,215 | 7,689,249 | 7,621,442 | 7,575,172 |
| 7,357,311 | 7,380,709 | 7,428,986 | 7,403,796 | 7,407,092 |
| 7,848,777 | 7,637,424 | 7,469,829 | 7,774,025 | 7,558,597 |
| 7,558,598 | 6,238,115 | 6,386,535 | 6,398,344 | 6,612,240 |
| 6,752,549 | 6,805,049 | 6,971,313 | 6,899,480 | 6,860,664 |
| 6,925,935 | 6,966,636 | 7,024,995 | 7,284,852 | 6,926,455 |
| 7,056,038 | 6,869,172 | 7,021,843 | 6,988,845 | 6,964,533 |

-continued

| | | | | |
|---|---|---|---|---|
| 6,981,809 | 7,284,822 | 7,258,067 | 7,322,757 | 7,222,941 |
| 7,284,925 | 7,278,795 | 7,249,904 | 7,364,286 | 7,677,682 |
| 7,771,019 | 7,878,629 | 7,845,791 | 6,087,638 | 6,340,222 |
| 6,041,600 | 6,299,300 | 6,067,797 | 6,286,935 | 6,044,646 |
| 6,382,769 | 6,787,051 | 6,938,990 | 7,588,693 | 7,416,282 |
| 7,481,943 | 11/861,282 | 7,678,667 | 7,152,972 | 7,513,615 |
| 6,390,605 | 6,322,195 | 6,612,110 | 6,480,089 | 6,460,778 |
| 6,305,788 | 6,426,014 | 6,364,453 | 6,457,795 | 6,315,399 |
| 6,338,548 | 7,040,736 | 6,938,992 | 6,994,425 | 6,863,379 |
| 6,540,319 | 6,994,421 | 6,984,019 | 7,008,043 | 6,997,544 |
| 6,328,431 | 6,991,310 | 7,465,007 | 7,140,723 | 6,328,425 |
| 6,982,184 | 7,267,423 | 7,134,741 | 7,066,577 | 7,152,945 |
| 7,303,689 | 7,021,744 | 6,991,320 | 7,155,911 | 7,464,547 |
| 6,595,624 | 7,152,943 | 7,125,103 | 7,328,971 | 7,290,857 |
| 7,285,437 | 7,229,151 | 7,341,331 | 7,237,873 | 7,901,053 |
| 7,545,251 | 7,465,405 | 7,213,907 | 6,417,757 | 7,581,819 |
| 7,695,108 | 7,530,669 | 7,556,344 | 7,387,364 | 7,517,037 |
| 7,467,851 | 7,654,638 | 7,556,348 | 7,581,817 | 7,095,309 |
| 6,854,825 | 6,623,106 | 6,672,707 | 6,575,561 | 6,817,700 |
| 6,588,885 | 7,075,677 | 6,428,139 | 6,575,549 | 6,846,692 |
| 6,425,971 | 7,063,993 | 6,383,833 | 6,955,414 | 6,412,908 |
| 6,746,105 | 6,953,236 | 6,412,904 | 7,128,388 | 6,398,343 |
| 6,652,071 | 6,793,323 | 6,659,590 | 6,676,245 | 7,201,460 |
| 6,464,332 | 6,659,593 | 6,478,406 | 6,978,613 | 6,439,693 |
| 6,502,306 | 6,966,111 | 6,863,369 | 6,428,142 | 6,874,868 |
| 6,390,591 | 6,799,828 | 6,896,358 | 7,018,016 | 7,380,905 |
| 6,328,417 | 6,322,194 | 6,382,779 | 6,629,745 | 6,565,193 |
| 6,609,786 | 6,609,787 | 6,439,908 | 6,684,503 | 6,843,551 |
| 6,764,166 | 6,561,617 | 7,328,967 | 6,557,970 | 6,546,628 |
| 7,407,269 | 6,652,074 | 6,820,968 | 7,175,260 | 6,682,174 |
| 7,303,262 | 6,648,453 | 6,834,932 | 6,682,176 | 6,998,062 |
| 6,767,077 | 7,278,717 | 6,755,509 | 7,347,537 | 6,692,108 |
| 7,407,271 | 6,672,709 | 7,303,263 | 7,086,718 | 7,429,097 |
| 6,672,710 | 7,465,034 | 6,669,334 | 7,322,686 | 7,152,958 |
| 7,281,782 | 6,824,246 | 7,264,336 | 6,669,333 | 7,357,489 |
| 6,820,967 | 7,306,326 | 6,736,489 | 7,264,335 | 6,719,406 |
| 7,222,943 | 7,188,419 | 7,168,166 | 6,974,209 | 7,086,719 |
| 6,974,210 | 7,195,338 | 7,252,775 | 7,101,025 | 7,597,423 |
| 7,533,963 | 7,469,995 | 7,587,823 | 7,587,822 | 7,658,472 |
| 7,401,903 | 7,416,284 | 7,722,168 | 7,744,191 | 7,866,795 |
| 7,819,503 | 7,744,195 | 7,645,026 | 7,322,681 | 7,708,387 |
| 7,753,496 | 7,712,884 | 7,510,267 | 7,465,041 | 7,857,428 |
| 7,465,032 | 7,401,890 | 7,401,910 | 7,470,010 | 7,735,971 |
| 7,431,432 | 7,465,037 | 7,445,317 | 7,549,735 | 7,597,425 |
| 7,661,800 | 7,712,869 | 7,712,876 | 7,712,859 | 7,794,061 |
| 7,845,765 | 7,798,603 | 7,784,902 | 7,775,630 | 7,824,010 |
| 7,841,695 | 7,156,508 | 7,159,972 | 7,083,271 | 7,165,834 |
| 7,080,894 | 7,201,469 | 7,090,336 | 7,156,489 | 7,413,283 |
| 7,438,385 | 7,083,257 | 7,258,422 | 7,255,423 | 7,219,980 |
| 7,591,533 | 7,416,274 | 7,367,649 | 7,118,192 | 7,618,121 |
| 7,322,672 | 7,077,505 | 7,198,354 | 7,077,504 | 7,614,724 |
| 7,198,355 | 7,401,894 | 7,322,676 | 7,152,959 | 7,213,906 |
| 7,178,901 | 7,222,938 | 7,108,353 | 7,104,629 | 7,455,392 |
| 7,370,939 | 7,429,095 | 7,404,621 | 7,261,401 | 7,461,919 |
| 7,438,388 | 7,328,972 | 7,322,673 | 7,306,324 | 7,306,325 |
| 7,524,021 | 7,399,071 | 7,556,360 | 7,303,261 | 7,568,786 |
| 7,517,049 | 7,549,727 | 7,399,053 | 7,467,849 | 7,556,349 |
| 7,648,226 | 7,726,790 | 7,303,930 | 7,401,405 | 7,464,466 |
| 7,464,465 | 11/860,538 | 11/860,539 | 7,824,013 | 7,659,141 |
| 7,618,842 | 7,246,886 | 7,128,400 | 7,108,355 | 6,991,322 |
| 7,287,836 | 7,118,197 | 7,575,298 | 7,364,269 | 7,077,493 |
| 6,962,402 | 7,686,429 | 7,147,308 | 7,524,034 | 7,118,198 |
| 7,168,790 | 7,172,270 | 7,229,155 | 6,830,318 | 7,195,342 |
| 7,175,261 | 7,465,035 | 7,108,356 | 7,118,202 | 7,510,269 |
| 7,134,744 | 7,510,270 | 7,134,743 | 7,182,439 | 7,210,768 |
| 7,465,036 | 7,134,745 | 7,156,484 | 7,118,201 | 7,111,926 |
| 7,431,433 | 7,018,021 | 7,401,901 | 7,468,139 | 7,128,402 |
| 7,387,369 | 7,484,832 | 7,802,871 | 7,506,968 | 7,284,839 |
| 7,246,885 | 7,229,156 | 7,533,970 | 7,467,855 | 7,293,858 |
| 7,520,594 | 7,588,321 | 7,258,427 | 7,556,350 | 7,278,716 |
| 7,841,704 | 7,524,028 | 7,467,856 | 7,469,996 | 7,506,963 |
| 7,533,968 | 7,556,354 | 7,524,030 | 7,581,822 | 7,533,964 |
| 7,549,729 | 7,771,023 | 7,543,916 | 7,448,729 | 7,246,876 |
| 7,431,431 | 7,419,249 | 7,377,623 | 7,328,978 | 7,334,876 |
| 7,147,306 | 7,261,394 | 7,611,218 | 7,637,593 | 7,654,645 |
| 7,784,915 | 7,491,911 | 7,780,271 | 7,376,273 | 7,832,630 |
| 7,738,744 | 7,400,769 | 11/756,628 | 7,859,699 | 7,568,622 |
| 11/756,631 | 7,466,440 | 7,249,901 | 7,477,987 | 7,812,987 |
| 7,503,493 | 7,156,289 | 7,178,718 | 7,225,979 | 7,380,712 |
| 7,540,429 | 7,584,402 | 7,721,948 | 7,079,712 | 6,825,945 |

-continued

| | | | | |
|---|---|---|---|---|
| 7,330,974 | 6,813,039 | 7,190,474 | 6,987,506 | 6,824,044 |
| 7,038,797 | 6,980,318 | 6,816,274 | 7,102,772 | 7,350,236 |
| 6,681,045 | 6,678,499 | 6,679,420 | 6,963,845 | 6,976,220 |
| 6,728,000 | 7,110,126 | 7,173,722 | 6,976,035 | 6,813,558 |
| 6,766,942 | 6,965,454 | 6,995,859 | 7,088,459 | 6,720,985 |
| 7,286,113 | 6,922,779 | 6,978,019 | 6,847,883 | 7,131,058 |
| 7,295,839 | 7,406,445 | 7,533,031 | 6,959,298 | 6,973,450 |
| 7,150,404 | 6,965,882 | 7,233,924 | 7,707,082 | 7,593,899 |
| 7,175,079 | 7,162,259 | 6,718,061 | 7,464,880 | 7,012,710 |
| 6,825,956 | 7,451,115 | 7,222,098 | 7,590,561 | 7,263,508 |
| 7,031,010 | 6,972,864 | 6,862,105 | 7,009,738 | 6,989,911 |
| 6,982,807 | 7,518,756 | 6,829,387 | 6,714,678 | 6,644,545 |
| 6,609,653 | 6,651,879 | 10/291,555 | 7,293,240 | 7,467,185 |
| 7,415,668 | 7,044,363 | 7,004,390 | 6,867,880 | 7,034,953 |
| 6,987,581 | 7,216,224 | 7,506,153 | 7,162,269 | 7,162,222 |
| 7,290,210 | 7,293,233 | 7,293,234 | 6,850,931 | 6,865,570 |
| 6,847,961 | 10/685,583 | 7,162,442 | 10/685,584 | 7,159,784 |
| 7,557,944 | 7,404,144 | 6,889,896 | 7,174,056 | 6,996,274 |
| 7,162,088 | 7,388,985 | 7,417,759 | 7,362,463 | 7,259,884 |
| 7,167,270 | 7,388,685 | 6,986,459 | 10/954,170 | 7,181,448 |
| 7,590,622 | 7,657,510 | 7,324,989 | 7,231,293 | 7,174,329 |
| 7,369,261 | 7,295,922 | 7,200,591 | 7,693,828 | 7,844,621 |
| 7,856,447 | 7,856,444 | 7,466,436 | 7,347,357 | 11/051,032 |
| 7,382,482 | 7,602,515 | 7,446,893 | 7,389,423 | 7,401,227 |
| 6,991,153 | 6,991,154 | 7,589,854 | 7,551,305 | 7,322,524 |
| 7,408,670 | 7,466,439 | 7,571,193 | 11/222,977 | 7,327,485 |
| 7,428,070 | 7,225,402 | 7,577,428 | 7,797,528 | 7,450,264 |
| 7,580,698 | 7,271,931 | 7,857,201 | 7,430,058 | 7,760,371 |
| 11/739,032 | 7,421,337 | 7,336,389 | 7,539,937 | 11/830,849 |
| 7,460,713 | 11/866,394 | 7,068,382 | 7,007,851 | 6,957,921 |
| 6,457,883 | 7,044,381 | 11/203,205 | 7,094,910 | 7,091,344 |
| 7,122,685 | 7,038,066 | 7,099,019 | 7,062,651 | 6,789,194 |
| 6,789,191 | 7,529,936 | 7,278,018 | 7,360,089 | 7,526,647 |
| 7,467,416 | 6,644,642 | 6,502,614 | 6,622,999 | 6,669,385 |
| 6,827,116 | 7,011,128 | 7,416,009 | 6,549,935 | 6,987,573 |
| 6,727,996 | 6,591,884 | 6,439,706 | 6,760,119 | 7,295,332 |
| 7,064,851 | 6,826,547 | 6,290,349 | 6,428,155 | 6,785,016 |
| 6,831,682 | 6,741,871 | 6,927,871 | 6,980,306 | 6,965,439 |
| 6,840,606 | 7,036,918 | 6,977,746 | 6,970,264 | 7,068,389 |
| 7,093,991 | 7,190,491 | 7,511,847 | 7,663,780 | 10/962,412 |
| 7,177,054 | 7,364,282 | 10/965,733 | 7,728,872 | 7,468,809 |
| 7,180,609 | 7,538,793 | 7,466,438 | 7,292,363 | 7,515,292 |
| 7,576,876 | 7,414,741 | 7,202,959 | 7,728,991 | 7,573,588 |
| 7,466,434 | 7,688,457 | 6,982,798 | 6,870,966 | 6,822,639 |
| 6,474,888 | 6,627,870 | 6,724,374 | 6,788,982 | 7,263,270 |
| 6,788,293 | 6,946,672 | 6,737,591 | 7,091,960 | 7,369,265 |
| 6,792,165 | 7,105,753 | 6,795,593 | 6,980,704 | 6,768,821 |
| 7,132,612 | 7,041,916 | 6,797,895 | 7,015,901 | 7,289,882 |
| 7,148,644 | 10/778,056 | 7,515,186 | 7,567,279 | 7,096,199 |
| 7,286,887 | 7,400,937 | 7,474,930 | 7,324,859 | 7,218,978 |
| 7,245,294 | 7,277,085 | 7,187,370 | 7,609,410 | 7,660,490 |
| 10/919,379 | 7,019,319 | 7,593,604 | 7,660,489 | 7,043,096 |
| 7,148,499 | 7,463,250 | 7,590,311 | 11/155,557 | 11/193,481 |
| 7,567,241 | 11/193,482 | 11/193,479 | 7,336,267 | 7,388,221 |
| 7,577,317 | 7,245,760 | 7,649,523 | 7,794,167 | 11/495,823 |
| 7,657,128 | 7,523,672 | 7,898,532 | 7,777,911 | 7,358,697 |
| 7,786,978 | 11/839,494 | 7,650,197 | 7,533,816 | 7,613,533 |
| 11/866,336 | 7,580,764 | 7,580,765 | 7,055,739 | 7,233,320 |
| 6,830,196 | 6,832,717 | 7,182,247 | 7,120,853 | 7,082,562 |
| 6,843,420 | 7,793,852 | 6,789,731 | 7,057,608 | 6,766,944 |
| 6,766,945 | 7,289,103 | 7,412,651 | 7,299,969 | 7,264,173 |
| 7,108,192 | 7,549,595 | 7,111,791 | 7,077,333 | 6,983,878 |
| 7,564,605 | 7,134,598 | 7,431,219 | 6,929,186 | 6,994,264 |
| 7,017,826 | 7,014,123 | 7,134,601 | 7,150,396 | 7,469,830 |
| 7,017,823 | 7,025,276 | 7,284,701 | 7,080,780 | 7,376,884 |
| 7,334,739 | 7,380,727 | 11/842,948 | 10/492,169 | 7,469,062 |
| 7,359,551 | 7,444,021 | 7,308,148 | 7,630,962 | 7,630,553 |
| 7,630,554 | 10/510,391 | 7,660,466 | 7,526,128 | 6,957,768 |
| 7,456,820 | 7,170,499 | 7,106,888 | 7,123,239 | 6,982,701 |
| 6,982,703 | 7,227,527 | 6,786,397 | 6,947,027 | 6,975,299 |
| 7,139,431 | 7,048,178 | 7,118,025 | 6,839,053 | 7,015,900 |
| 7,010,147 | 7,133,557 | 6,914,593 | 7,437,671 | 6,938,826 |
| 7,278,566 | 7,123,245 | 6,992,662 | 7,190,346 | 7,417,629 |
| 7,468,724 | 7,382,354 | 7,715,035 | 7,221,781 | 11/102,843 |
| 7,213,756 | 7,362,314 | 7,180,507 | 7,263,225 | 7,287,688 |
| 7,530,501 | 7,751,090 | 7,864,162 | 11/865,711 | 11/856,061 |
| 11/856,062 | 11/856,064 | 11/856,066 | 7,762,453 | 7,821,507 |
| 11/672,947 | 7,793,824 | 7,760,969 | 11/672,533 | 11/754,319 |
| 7,775,440 | 11/754,316 | 7,855,811 | 11/754,312 | 11/754,311 |
| 6,593,166 | 7,132,679 | 6,940,088 | 7,119,357 | 7,307,272 |

-continued

| | | | | |
|---|---|---|---|---|
| 6,755,513 | 6,974,204 | 6,409,323 | 7,055,930 | 6,281,912 |
| 6,893,109 | 6,604,810 | 6,824,242 | 6,318,920 | 7,210,867 |
| 6,488,422 | 6,655,786 | 6,457,810 | 6,485,135 | 6,796,731 |
| 6,904,678 | 6,641,253 | 7,125,106 | 6,786,658 | 7,097,273 |
| 6,824,245 | 7,222,947 | 6,918,649 | 6,860,581 | 6,929,351 |
| 7,063,404 | 6,969,150 | 7,004,652 | 6,871,938 | 6,905,194 |
| 6,846,059 | 6,997,626 | 7,303,256 | 7,029,098 | 6,966,625 |
| 7,114,794 | 7,207,646 | 7,077,496 | 7,284,831 | 7,357,484 |
| 7,152,938 | 7,182,434 | 7,182,430 | 7,306,317 | 7,032,993 |
| 7,325,905 | 7,407,259 | 7,357,475 | 7,172,266 | 7,258,430 |
| 7,128,392 | 7,210,866 | 7,306,322 | 7,591,529 | 7,384,127 |
| 7,427,123 | 7,354,208 | 7,416,272 | 7,416,277 | 7,357,583 |
| 7,712,866 | 7,758,181 | 7,775,640 | 7,690,761 | 7,468,284 |
| 7,341,330 | 7,372,145 | 7,425,052 | 7,287,831 | 6,804,030 |
| 6,807,315 | 6,771,811 | 6,683,996 | 7,271,936 | 7,304,771 |
| 6,965,691 | 7,058,219 | 7,289,681 | 7,187,807 | 7,181,063 |
| 7,366,351 | 7,471,413 | 7,349,572 | 7,377,608 | 7,399,043 |
| 7,121,639 | 7,165,824 | 7,152,942 | 7,818,519 | 7,181,572 |
| 7,096,137 | 7,302,592 | 7,278,034 | 7,188,282 | 7,592,829 |
| 7,770,008 | 7,707,621 | 7,523,111 | 7,573,301 | 7,660,998 |
| 7,783,886 | 7,831,827 | 7,171,323 | 7,278,697 | 7,465,005 |
| 7,360,131 | 7,519,772 | 7,328,115 | 7,747,887 | 7,805,626 |
| 7,369,270 | 6,795,215 | 7,070,098 | 7,154,638 | 6,805,419 |
| 6,859,289 | 6,977,751 | 6,398,332 | 6,394,573 | 6,622,923 |
| 6,747,760 | 6,921,144 | 7,092,112 | 7,192,106 | 7,457,001 |
| 7,173,739 | 6,986,560 | 7,008,033 | 7,551,324 | 7,222,780 |
| 7,270,391 | 7,150,510 | 7,525,677 | 7,388,689 | 7,407,247 |
| 7,398,916 | 7,571,906 | 7,753,490 | 7,654,628 | 7,611,220 |
| 7,524,018 | 7,771,004 | 7,556,353 | 7,195,328 | 7,182,422 |
| 7,866,791 | 7,841,703 | 7,374,266 | 7,427,117 | 7,448,707 |
| 7,281,330 | 7,328,956 | 7,735,944 | 7,188,928 | 7,093,989 |
| 7,377,609 | 7,600,843 | 10/854,498 | 7,390,071 | 7,549,715 |
| 7,252,353 | 7,607,757 | 7,267,417 | 7,517,036 | 7,275,805 |
| 7,314,261 | 7,281,777 | 7,290,852 | 7,484,831 | 7,758,143 |
| 7,832,842 | 7,549,718 | 7,866,778 | 7,631,190 | 7,557,941 |
| 7,757,086 | 7,266,661 | 7,243,193 | 7,163,345 | 7,322,666 |
| 7,566,111 | 7,434,910 | 7,837,284 | 7,775,616 | 7,465,016 |
| 7,891,766 | 11/778,569 | 7,467,836 | 7,543,808 | 6,924,907 |
| 6,712,452 | 6,416,160 | 6,238,043 | 6,958,826 | 6,812,972 |
| 6,553,459 | 6,967,741 | 6,956,669 | 6,903,766 | 6,804,026 |
| 7,259,889 | 6,975,429 | 7,518,634 | 7,301,567 | 7,576,775 |
| 7,274,485 | 7,139,084 | 7,173,735 | 7,068,394 | 7,286,182 |
| 7,086,644 | 7,250,977 | 7,146,281 | 7,023,567 | 7,136,183 |
| 7,083,254 | 6,796,651 | 7,061,643 | 7,057,758 | 6,894,810 |
| 6,995,871 | 7,085,010 | 7,092,126 | 7,123,382 | 7,061,650 |
| 7,466,353 | 6,986,573 | 6,974,212 | 7,307,756 | 7,173,737 |
| 7,557,828 | 7,246,868 | 7,399,076 | 7,137,699 | 7,576,776 |
| 7,148,994 | 7,077,497 | 11/176,372 | 7,248,376 | 7,306,321 |
| 7,173,729 | 7,372,601 | 11/478,607 | 7,426,044 | 7,878,646 |
| 7,517,080 | 7,468,816 | 7,466,452 | 7,385,713 | 7,585,067 |
| 7,609,397 | 7,468,807 | 11/544,764 | 7,819,494 | 11/544,772 |
| 11/544,774 | 7,845,747 | 7,425,048 | 11/544,766 | 7,780,256 |
| 7,384,128 | 7,604,321 | 7,722,163 | 7,681,970 | 7,425,047 |
| 7,413,288 | 7,465,033 | 7,452,055 | 7,470,002 | 7,722,161 |
| 7,475,963 | 7,448,735 | 7,465,042 | 7,448,739 | 7,438,399 |
| 7,467,853 | 7,461,922 | 7,465,020 | 7,722,185 | 7,461,910 |
| 7,270,494 | 7,632,032 | 7,475,961 | 7,547,088 | 7,611,239 |
| 7,735,955 | 7,758,038 | 7,681,876 | 7,780,161 | 7,914,217 |
| 7,703,903 | 7,703,900 | 7,703,901 | 7,722,170 | 7,857,441 |
| 7,784,925 | 7,794,068 | 7,794,038 | 7,448,734 | 7,425,050 |
| 7,364,263 | 7,201,468 | 7,360,868 | 7,234,802 | 7,303,255 |
| 7,287,846 | 7,156,511 | 7,258,432 | 7,097,291 | 7,645,025 |
| 7,083,273 | 7,367,647 | 7,374,355 | 7,441,880 | 7,547,092 |
| 7,513,598 | 7,198,352 | 7,364,264 | 7,303,251 | 7,201,470 |
| 7,121,655 | 7,293,861 | 7,232,208 | 7,328,985 | 7,344,232 |
| 7,083,272 | 7,261,400 | 7,461,914 | 7,431,441 | 7,311,387 |
| 7,303,258 | 7,824,002 | 7,517,050 | 7,708,391 | 7,850,269 |
| 7,798,622 | 7,740,340 | 7,794,070 | 7,883,194 | 7,621,620 |
| 7,669,961 | 7,331,663 | 7,360,861 | 7,328,973 | 7,427,121 |
| 7,407,262 | 7,303,252 | 7,249,822 | 7,537,309 | 7,311,382 |
| 7,360,860 | 7,364,257 | 7,390,075 | 7,350,896 | 7,429,096 |
| 7,384,135 | 7,331,660 | 7,416,287 | 7,488,052 | 7,322,684 |
| 7,322,685 | 7,311,381 | 7,270,405 | 7,303,268 | 7,470,007 |
| 7,399,072 | 7,393,076 | 7,681,967 | 7,588,301 | 7,249,833 |
| 7,547,098 | 7,703,886 | 7,467,860 | 7,524,016 | 7,490,927 |
| 7,331,661 | 7,524,043 | 7,300,140 | 7,357,492 | 7,357,493 |
| 7,566,106 | 7,380,902 | 7,284,816 | 7,284,845 | 7,255,430 |
| 7,390,080 | 7,328,984 | 7,350,913 | 7,322,671 | 7,380,910 |
| 7,431,424 | 7,470,006 | 7,585,054 | 7,347,534 | 7,441,865 |
| 7,469,989 | 7,367,650 | 7,726,789 | 7,914,140 | 7,748,828 |

-continued

| | | | | |
|---|---|---|---|---|
| 7,469,990 | 7,441,882 | 7,556,364 | 7,357,496 | 7,467,863 |
| 7,431,440 | 7,431,443 | 7,527,353 | 7,524,023 | 7,513,603 |
| 7,467,852 | 7,465,045 | 11/688,863 | 7,837,297 | 7,475,976 |
| 7,364,265 | 11/688,867 | 7,758,177 | 7,780,278 | 11/688,871 |
| 7,819,507 | 7,654,640 | 7,721,441 | 7,645,034 | 7,637,602 |
| 7,645,033 | 7,661,803 | 7,841,708 | 7,771,029 | 11/677,050 |
| 7,658,482 | 7,306,320 | 7,111,935 | 7,562,971 | 7,735,982 |
| 7,604,322 | 7,261,482 | 7,002,664 | 7,088,420 | 7,470,014 |
| 7,470,020 | 7,540,601 | 7,654,761 | 6,364,451 | 6,533,390 |
| 6,454,378 | 7,224,478 | 6,559,969 | 6,896,362 | 7,057,760 |
| 6,982,799 | 7,528,972 | 7,649,647 | 7,649,648 | 7,808,669 |
| 7,093,494 | 7,143,652 | 7,089,797 | 7,159,467 | 7,234,357 |
| 7,124,643 | 7,121,145 | 7,089,790 | 7,194,901 | 6,968,744 |
| 7,089,798 | 7,240,560 | 7,137,302 | 7,350,417 | 7,171,855 |
| 7,260,995 | 7,260,993 | 7,165,460 | 7,222,538 | 7,258,019 |
| 7,549,342 | 7,258,020 | 7,367,235 | 7,334,480 | 7,380,460 |
| 7,549,328 | 7,461,558 | 7,770,441 | 7,458,272 | 7,430,919 |
| 7,568,395 | 7,644,621 | 6,454,482 | 6,808,330 | 6,527,365 |
| 6,474,773 | 6,550,997 | 7,093,923 | 6,957,923 | 7,131,724 |
| 7,396,177 | 7,168,867 | 7,125,098 | 7,396,178 | 7,413,363 |
| 7,188,930 | 7,377,635 | 7,686,446 | 7,237,888 | 7,168,654 |
| 7,201,272 | 6,991,098 | 7,217,051 | 6,944,970 | 7,108,434 |
| 7,210,407 | 7,186,042 | 6,920,704 | 7,217,049 | 7,607,756 |
| 7,147,102 | 7,287,828 | 7,249,838 | 7,431,446 | 7,611,237 |
| 7,261,477 | 7,225,739 | 7,712,886 | 7,665,836 | 7,419,053 |
| 7,191,978 | 7,524,046 | 7,163,287 | 7,258,415 | 7,322,677 |
| 7,258,424 | 7,484,841 | 7,195,412 | 7,207,670 | 7,270,401 |
| 7,220,072 | 7,588,381 | 7,726,785 | 7,578,387 | 7,575,316 |
| 7,384,206 | 7,628,557 | 7,470,074 | 7,425,063 | 7,429,104 |
| 7,556,446 | 7,367,267 | 7,901,065 | 7,891,758 | 7,794,051 |
| 7,448,551 | 7,399,065 | 7,695,204 | 7,322,761 | 7,735,994 |
| 6,716,666 | 6,949,217 | 6,750,083 | 7,014,451 | 6,777,259 |
| 6,923,524 | 6,557,978 | 6,991,207 | 6,766,998 | 6,967,354 |
| 6,759,723 | 6,870,259 | 7,875,230 | 6,925,875 | 7,618,575 |
| 7,095,109 | 7,145,696 | 7,461,931 | 7,193,482 | 7,134,739 |
| 7,222,939 | 7,164,501 | 7,118,186 | 7,201,523 | 7,226,159 |
| 7,249,839 | 7,108,343 | 7,154,626 | 7,079,292 | 7,580,068 |
| 7,233,421 | 7,063,408 | 7,377,706 | 7,572,000 | 7,032,996 |
| 7,533,022 | 7,605,851 | 7,349,216 | 7,217,046 | 6,948,870 |
| 7,195,336 | 7,070,257 | 7,669,965 | 7,677,687 | 7,093,922 |
| 6,988,789 | 7,371,024 | 7,246,871 | 7,612,825 | 7,441,866 |
| 7,187,468 | 7,196,814 | 7,372,593 | 7,268,911 | 7,265,869 |
| 7,128,384 | 7,164,505 | 7,284,805 | 7,025,434 | 7,298,519 |
| 7,280,244 | 7,206,098 | 7,265,877 | 7,193,743 | 7,168,777 |
| 11/006,734 | 7,195,329 | 7,198,346 | 7,281,786 | 7,518,642 |
| 7,918,540 | 6,959,983 | 7,128,386 | 7,097,104 | 7,350,889 |
| 7,083,261 | 7,070,258 | 7,083,275 | 7,110,139 | 6,994,419 |
| 6,935,725 | 7,398,597 | 7,178,892 | 7,219,429 | 6,988,784 |
| 7,604,345 | 7,289,156 | 7,407,614 | 7,284,976 | 7,178,903 |
| 7,273,274 | 7,083,256 | 7,325,986 | 7,278,707 | 7,325,918 |
| 6,974,206 | 7,364,258 | 7,066,588 | 7,222,940 | 7,543,924 |
| 7,018,025 | 7,221,867 | 7,290,863 | 7,188,938 | 7,021,742 |
| 7,083,262 | 7,192,119 | 7,073,892 | 7,036,912 | 7,175,256 |
| 7,182,441 | 7,083,258 | 7,114,796 | 7,147,302 | 7,380,906 |
| 7,219,982 | 7,118,195 | 7,229,153 | 6,991,318 | 7,108,346 |
| 7,556,370 | 7,404,617 | 7,178,899 | 7,066,579 | 7,425,053 |
| 7,441,885 | 7,826,088 | 7,270,397 | 7,258,425 | 7,237,874 |
| 7,152,961 | 7,333,235 | 7,207,658 | 7,465,013 | 7,311,257 |
| 7,207,659 | 7,497,555 | 7,540,592 | 7,540,602 | 7,400,419 |
| 7,306,307 | 7,843,588 | 7,433,073 | 7,537,325 | 7,537,317 |
| 7,329,061 | 7,549,726 | 7,677,698 | 7,278,713 | 7,391,531 |
| 7,419,244 | 7,566,125 | 7,467,903 | 7,290,853 | 7,581,831 |
| 7,506,964 | 11/737,139 | 7,556,347 | 7,387,365 | 11/749,122 |
| 7,753,503 | 7,540,582 | 7,784,931 | 7,717,538 | 7,468,808 |
| 7,401,902 | 7,784,932 | 11/858,852 | 6,485,123 | 6,425,657 |
| 6,488,358 | 7,021,746 | 6,712,986 | 6,981,757 | 6,505,912 |
| 6,439,694 | 6,364,461 | 6,378,990 | 6,425,658 | 6,488,361 |
| 6,814,429 | 6,471,336 | 6,457,813 | 6,540,331 | 6,454,396 |
| 6,464,325 | 6,443,559 | 6,435,664 | 6,412,914 | 6,488,360 |
| 6,550,896 | 6,439,695 | 6,447,100 | 7,381,340 | 6,488,359 |
| 6,637,873 | 7,443,434 | 6,618,117 | 6,803,989 | 7,234,801 |
| 7,044,589 | 7,163,273 | 6,416,154 | 6,547,364 | 7,722,172 |
| 6,644,771 | 7,152,939 | 6,565,181 | 7,325,897 | 6,857,719 |
| 7,255,414 | 6,702,417 | 7,284,843 | 6,918,654 | 7,070,265 |
| 6,616,271 | 6,652,078 | 6,503,408 | 6,607,263 | 7,111,924 |
| 6,623,108 | 6,698,867 | 6,488,362 | 6,625,874 | 6,921,153 |
| 7,198,356 | 6,536,874 | 6,425,651 | 6,435,667 | 10/509,997 |
| 6,527,374 | 7,334,873 | 6,582,059 | 7,631,957 | 6,513,908 |
| 7,246,883 | 6,540,332 | 6,547,368 | 7,070,256 | 6,508,546 |
| 7,758,142 | 6,679,584 | 7,303,254 | 6,857,724 | 7,753,463 |

-continued

| | | | | |
|---|---|---|---|---|
| 6,652,052 | 10/509,999 | 6,672,706 | 7,661,792 | 6,688,719 |
| 6,712,924 | 6,588,886 | 7,077,508 | 7,207,654 | 6,935,724 |
| 6,927,786 | 6,988,787 | 6,899,415 | 6,672,708 | 6,644,767 |
| 6,874,866 | 6,830,316 | 6,994,420 | 6,954,254 | 7,086,720 |
| 7,240,992 | 7,267,424 | 7,128,397 | 7,084,951 | 7,156,496 |
| 7,066,578 | 7,101,023 | 7,431,427 | 7,452,048 | 7,399,063 |
| 7,159,965 | 7,255,424 | 7,581,826 | 7,137,686 | 7,201,472 |
| 7,287,829 | 7,793,853 | 7,216,957 | 7,483,053 | 7,461,923 |
| 7,517,071 | 7,506,961 | 7,278,712 | 7,524,033 | 7,465,025 |
| 7,287,827 | 7,575,313 | 7,364,271 | 7,556,355 | 7,566,113 |
| 7,524,031 | 11/863,260 | 6,916,082 | 6,786,570 | 7,407,261 |
| 6,848,780 | 6,966,633 | 7,179,395 | 6,969,153 | 6,979,075 |
| 7,132,056 | 6,832,828 | 6,860,590 | 6,905,620 | 6,786,574 |
| 6,824,252 | 7,097,282 | 6,997,545 | 6,971,734 | 6,918,652 |
| 6,978,990 | 6,863,105 | 7,454,617 | 7,194,629 | 10/791,792 |
| 6,890,059 | 6,988,785 | 6,830,315 | 7,246,881 | 7,125,102 |
| 7,028,474 | 7,066,575 | 6,986,202 | 7,044,584 | 7,210,762 |
| 7,032,992 | 7,140,720 | 7,207,656 | 7,285,170 | 7,416,275 |
| 7,008,041 | 7,011,390 | 7,048,868 | 7,014,785 | 7,131,717 |
| 7,284,826 | 7,331,101 | 7,182,436 | 7,104,631 | 7,240,993 |
| 7,290,859 | 7,556,358 | 7,172,265 | 7,284,837 | 7,066,573 |
| 7,364,270 | 7,152,949 | 7,334,877 | 7,380,913 | 7,326,357 |
| 7,156,492 | 7,566,110 | 7,331,653 | 7,287,834 | 7,637,594 |
| 7,413,671 | 7,571,983 | 7,284,326 | 7,524,027 | 7,556,352 |
| 7,604,314 | 7,585,050 | 7,591,534 | 7,537,301 | 7,588,316 |
| 7,722,162 | 11/865,668 | 6,824,257 | 7,270,475 | 6,971,811 |
| 6,878,564 | 6,921,145 | 6,890,052 | 7,021,747 | 6,929,345 |
| 6,811,242 | 6,916,087 | 6,905,195 | 6,899,416 | 6,883,906 |
| 6,955,428 | 7,284,834 | 6,932,459 | 6,962,410 | 7,033,008 |
| 6,962,409 | 7,013,641 | 7,204,580 | 7,032,997 | 6,998,278 |
| 7,004,563 | 6,910,755 | 6,969,142 | 6,938,994 | 7,188,935 |
| 7,380,339 | 7,134,740 | 6,997,537 | 7,004,567 | 6,916,091 |
| 7,077,588 | 6,918,707 | 6,923,583 | 6,953,295 | 6,921,221 |
| 7,001,008 | 7,168,167 | 7,210,759 | 7,337,532 | 7,331,659 |
| 7,322,680 | 6,988,790 | 7,192,120 | 7,168,789 | 7,004,577 |
| 7,052,120 | 6,994,426 | 7,258,418 | 7,014,298 | 7,328,977 |
| 7,370,941 | 7,152,955 | 7,097,292 | 7,207,657 | 7,152,944 |
| 7,147,303 | 7,338,147 | 7,134,608 | 7,264,333 | 7,093,921 |
| 7,077,590 | 7,147,297 | 7,387,363 | 7,380,908 | 7,387,573 |
| 7,077,507 | 7,172,672 | 7,175,776 | 7,086,717 | 7,101,020 |
| 7,347,535 | 7,201,466 | 7,404,620 | 7,152,967 | 7,182,431 |
| 7,210,666 | 7,252,367 | 7,287,837 | 7,467,842 | 7,374,695 |
| 6,945,630 | 7,018,294 | 6,910,014 | 6,659,447 | 6,648,321 |
| 7,082,980 | 6,672,584 | 7,073,551 | 6,830,395 | 7,289,727 |
| 7,001,011 | 6,880,922 | 6,886,915 | 6,644,787 | 6,641,255 |
| 7,066,580 | 6,652,082 | 7,284,833 | 6,666,544 | 6,666,543 |
| 6,669,332 | 6,984,023 | 6,733,104 | 6,644,793 | 6,723,575 |
| 6,953,235 | 6,663,225 | 7,076,872 | 7,059,706 | 7,185,971 |
| 7,090,335 | 6,854,827 | 6,793,974 | 7,766,453 | 7,222,929 |
| 6,739,701 | 7,073,881 | 7,155,823 | 7,219,427 | 7,008,503 |
| 6,783,216 | 6,883,890 | 6,857,726 | 7,347,952 | 6,641,256 |
| 6,808,253 | 6,827,428 | 6,802,587 | 6,997,534 | 6,959,982 |
| 6,959,981 | 6,886,917 | 6,969,473 | 6,827,425 | 7,007,859 |
| 6,802,594 | 6,792,754 | 6,860,107 | 6,786,043 | 6,863,378 |
| 7,052,114 | 7,001,007 | 7,551,201 | 10/729,157 | 6,948,794 |
| 6,805,435 | 6,733,116 | 7,391,435 | 7,008,046 | 6,880,918 |
| 7,066,574 | 6,983,595 | 6,923,527 | 7,275,800 | 7,163,276 |
| 7,156,495 | 6,976,751 | 6,994,430 | 7,014,296 | 7,059,704 |
| 7,160,743 | 7,175,775 | 7,287,839 | 7,097,283 | 7,140,722 |
| 7,664,647 | 7,610,203 | 7,080,893 | 7,093,920 | 7,270,492 |
| 7,128,093 | 7,052,113 | 7,055,934 | 7,367,729 | 7,278,796 |
| 7,419,250 | 7,083,263 | 7,145,592 | 7,025,436 | 7,455,390 |
| 7,258,421 | 7,396,108 | 7,332,051 | 7,226,147 | 7,448,725 |
| 7,195,339 | 7,524,032 | 7,618,122 | 7,284,838 | 7,293,856 |
| 7,350,901 | 7,604,325 | 7,325,901 | 7,588,327 | 7,467,854 |
| 7,431,425 | 7,708,380 | 7,669,964 | 7,465,011 | 7,517,055 |
| 7,465,024 | 7,347,536 | 7,380,580 | 7,441,873 | 7,506,969 |
| 7,571,972 | 7,635,177 | 7,661,795 | 7,370,942 | 7,322,679 |
| 7,607,826 | 7,784,910 | 7,585,066 | 7,845,869 | 7,527,209 |
| 7,517,164 | 7,562,967 | 7,067,067 | 6,776,476 | 6,880,914 |
| 7,086,709 | 6,783,217 | 7,147,791 | 6,929,352 | 7,144,095 |
| 6,820,974 | 6,918,647 | 6,984,016 | 7,192,125 | 6,824,251 |
| 6,834,939 | 6,840,600 | 6,786,573 | 7,144,519 | 6,799,835 |
| 6,959,975 | 6,959,974 | 7,021,740 | 6,935,718 | 6,938,983 |
| 6,938,991 | 7,226,145 | 7,140,719 | 6,988,788 | 7,022,250 |
| 6,929,350 | 7,011,393 | 7,004,566 | 7,175,097 | 6,948,799 |
| 7,143,944 | 7,310,157 | 7,029,100 | 6,957,811 | 7,073,724 |
| 7,055,933 | 7,077,490 | 7,055,940 | 7,484,840 | 7,234,645 |
| 7,032,999 | 7,066,576 | 7,229,150 | 7,086,728 | 7,246,879 |
| 7,284,825 | 7,140,718 | 7,284,817 | 7,144,098 | 7,044,577 |

-continued

| | | | | |
|---|---|---|---|---|
| 7,284,824 | 7,284,827 | 7,189,334 | 7,055,935 | 7,152,860 |
| 7,588,323 | 7,591,547 | 7,334,868 | 7,213,989 | 7,341,336 |
| 7,364,377 | 7,300,141 | 7,114,868 | 7,168,796 | 7,159,967 |
| 7,328,966 | 7,152,805 | 7,431,429 | 7,609,405 | 7,133,799 |
| 7,380,912 | 7,441,875 | 7,152,956 | 7,128,399 | 7,147,305 |
| 7,287,702 | 7,325,904 | 7,246,884 | 7,152,960 | 7,380,929 |
| 7,441,867 | 7,470,003 | 7,465,022 | 7,467,859 | 7,401,895 |
| 7,270,399 | 6,857,728 | 6,857,729 | 6,857,730 | 6,989,292 |
| 7,126,216 | 6,977,189 | 6,982,189 | 7,173,332 | 7,026,176 |
| 6,979,599 | 6,812,062 | 6,886,751 | 7,511,744 | 7,471,313 |
| 7,001,793 | 6,866,369 | 6,946,743 | 7,322,675 | 6,886,918 |
| 7,059,720 | 7,306,305 | 7,350,887 | 7,334,855 | 7,360,850 |
| 7,347,517 | 6,951,390 | 6,981,765 | 6,789,881 | 6,802,592 |
| 7,029,097 | 6,799,836 | 7,048,352 | 7,182,267 | 7,025,279 |
| 6,857,571 | 6,817,539 | 6,830,198 | 6,992,791 | 7,038,809 |
| 6,980,323 | 7,148,992 | 7,139,091 | 6,947,173 | 7,101,034 |
| 6,969,144 | 6,942,319 | 6,827,427 | 6,984,021 | 6,984,022 |
| 6,869,167 | 6,918,542 | 7,007,852 | 6,899,420 | 6,918,665 |
| 6,997,625 | 6,988,840 | 6,984,080 | 6,845,978 | 6,848,687 |
| 6,840,512 | 6,863,365 | 7,204,582 | 6,921,150 | 7,128,396 |
| 6,913,347 | 7,008,819 | 6,935,736 | 6,991,317 | 7,284,836 |
| 7,055,947 | 7,093,928 | 7,100,834 | 7,270,396 | 7,187,086 |
| 7,290,856 | 7,032,825 | 7,086,721 | 7,159,968 | 7,010,456 |
| 7,147,307 | 7,111,925 | 7,334,867 | 7,229,154 | 7,458,676 |
| 7,370,938 | 7,328,994 | 7,341,672 | 7,549,724 | 7,467,848 |
| 7,278,711 | 7,290,720 | 7,314,266 | 7,431,065 | 7,357,488 |
| 7,513,604 | 7,537,323 | 7,287,706 | 7,533,967 | 7,556,351 |
| 7,470,995 | 7,824,021 | 7,373,083 | 7,362,971 | 7,597,421 |
| 7,350,906 | 7,771,013 | 7,556,356 | 7,581,815 | 7,549,730 |
| 7,506,966 | 11/866,307 | 7,837,115 | 7,540,591 | 11/869,722 |
| 7,854,492 | | | | |

The disclosures of these applications and patents are incorporated herein by reference.

FIELD OF THE INVENTION

The present invention relates to a pressure regulator for an inkjet printer. It has been developed primarily for generating a negative hydrostatic pressure in an ink supply system supplying ink to printhead nozzles.

BACKGROUND OF THE INVENTION

The inkjet printheads described in the above cross referenced documents typically comprise an array of nozzles, each nozzle having an associated ink ejection actuator for ejecting ink from a nozzle opening defined in a roof of a nozzle chamber. Ink from an ink cartridge or other reservoir is fed to the chambers where the ejection actuators force droplets of ink through the nozzle opening for printing. Typically, an ink cartridge is a replaceable consumable in an inkjet printer.

Ink may be drawn into each nozzle chamber by suction generated after each drop ejection and by the capillary action of ink supply channels having hydrophilic surfaces (e.g. silicon dioxide surface). During periods of inactivity, ink is retained in the nozzle chambers by the surface tension of an ink meniscus pinned across a rim of each nozzle opening. If the ink pressure is not controlled, it may become positive with respect to external atmospheric pressure, possibly by thermal expansion of the ink, or a tipping of the printer that elevates the ink above the level of the nozzles. In this case the ink will flood onto the printhead surface. Moreover, during active printing, ink supplied through the ink supply channels has a momentum, which is sufficient to surge out of the nozzles and flood the printhead face once printing stops. Printhead face flooding is clearly undesirable in either of these scenarios.

To address this problem, many printhead ink supply systems are designed so that a hydrostatic pressure of ink at the nozzles is less than atmospheric pressure. This causes the meniscus across the nozzle openings to be concave or drawn inwards. The meniscus is pinned at nozzle openings, and the ink cannot freely flow out of the nozzles, both during inactive periods. Furthermore, face flooding as a result of ink surges are minimized.

The amount of negative pressure in the chambers is limited by two factors. It cannot be strong enough to de-prime the chambers (i.e. suck the ink out of the chambers and back towards the cartridge). However, if the negative pressure is too weak, the nozzles can leak ink onto the printhead face, especially if the printhead is jolted. Aside from these two catastrophic events requiring some form of remediation (e.g. printhead maintenance or re-priming), a sub-optimal hydrostatic ink pressure will typically cause an array of image defects during printing, with an appreciable loss of print quality. Accordingly, inkjet printers may have a relatively narrow window of hydrostatic ink pressures, which must be achieved by a pressure regulator in the ink supply system.

Typically, ink cartridges are designed to incorporate some means for regulating hydrostatic pressure of ink supplied therefrom. To establish a negative pressure, some cartridges use a flexible bag design. Part of the cartridge has a flexible bag or wall section that is biased towards increasing the ink storage volume. U.S. Ser. No. 11/014,764 and U.S. Ser. No. 11/014,769 (listed above in the cross referenced documents) are examples of this type of cartridge. These cartridges can provide a negative pressure, but tend to rely on excellent manufacturing tolerances of an internal leaf spring in the flexible bag. Further, the requirement of an internal biasing means in a flexible bag presents significant manufacturing difficulties.

Another means of generating a negative ink pressure via the ink cartridge is shown in FIG. 24. A piece of foam or porous material 2 is placed in the cartridge 1 over the outlet 3. The foam 2 has a section that is saturated with ink 4, and a section 5 that may be wet with ink, but not saturated. The top of the cartridge 1 is vented to atmosphere through the air maze 7. Capillary action (represented by arrow 6) draws the ink from the saturated section 4 into the unsaturated section 5. This continues until it is balanced by the weight of the increased hydrostatic pressure, or 'head' of ink drawn upwards by the capillary action 6. The hydrostatic pressure at the top of the saturated section 4 is less than atmospheric because of capillary action into the unsaturated section 5. From there, the hydrostatic pressure increases towards the outlet 3, and if connected to the printhead (not shown), it continues to increase down to the nozzle openings (assuming they are the lowest points in the printhead). By setting the proportion of saturated foam to unsaturated foam such that the hydrostatic pressure of the ink at the nozzle is less than atmospheric, the ink meniscus will form inwardly.

However, ink cartridges comprising foam inserts are generally unsuitable for high speed printing (e.g. print speeds of one page every 1-2 seconds) using the Applicant's pagewidth printheads, which print at up to 1600 dpi. In such high speed printers, there are a large number of nozzles having a higher firing rate than traditional scanning printers. Therefore the ink flow rate out of the cartridge is much greater than that of a scanning printhead. The hydraulic drag caused by the foam insert can starve the nozzles and retard the chamber refill rate. More porous foam would have less hydraulic drag but also much less capillary force. Further, accurate pressure control requires equally accurate control over the internal void dimensions, which is difficult to achieved by the stochastically formed void structures of most foam materials. Accordingly, porous foam inserts are not considered to be a viable means for controlling ink pressure at high ink flow rates.

As an alternative (or in addition) to ink cartridges having integral pressure regulators, the ink supply system may comprise a pressure regulator in the ink line between the printhead and an ink reservoir. The present Applicant's previously filed U.S. application Ser. Nos. 11/293,806 (filed on Dec. 5, 2005) and 11/293,842 (filed on Dec. 5, 2005), the contents of which are herein incorporated by reference, describe an in-line pressure regulator comprising a diaphragm and biasing mechanism. This mechanical arrangement is used to generate a negative hydrostatic ink pressure at the printhead. However, this type of mechanical pressure regulator has the drawback of requiring extremely fine manufacturing tolerances for a spring, which opens and closes the diaphragm in response to fluctuations in ink pressure upstream and downstream of the diaphragm. In practice, this mechanical system of pressure control makes it difficult to implement in an ink supply system required to maintain a constant negative hydrostatic ink pressure within a relatively narrow pressure range.

It would therefore be desirable to provide a pressure regulator, which is suitable for maintaining a hydrostatic ink pressure within a relatively narrow pressure range. It would further be desirable to provide a pressure regulator, which is suitable for use at relatively high ink flow rates. It would further be desirable to provide a pressure regulator, which is simple in construction and which does not require a plethora of moving parts manufactured with high tolerances. It would further be desirable to provide a pressure regulator, which does not leak ink as a result of pressure fluctuations during temperature cycling.

SUMMARY OF THE INVENTION

In a first aspect, there is provided an ink pressure regulator for regulating a hydrostatic pressure of ink supplied to an inkjet printhead, the regulator comprising:

- an ink chamber having an ink outlet for fluid communication with the printhead via an ink line;
- an air inlet;
- a regulator channel having a first end communicating with the air inlet and a second end communicating with a headspace of the chamber, the second end defining a bubble outlet;
- a wetting system for maintaining at least some liquid in the regulator channel, thereby ensuring that air entering the headspace first passes through the liquid, the wetting system comprising:
  - a first wetting chamber connected to the first end;
  - a second wetting chamber connected to the second end; and
  - a liquid-retaining structure positioned in at least one of the wetting chambers, such that the regulator channel, the first wetting chamber, the second wetting chamber and the liquid-retaining structure are all in fluid communication with each other, wherein the regulator channel is dimensioned to control a Laplace pressure of air bubbles drawn from the bubble outlet as result of supplying ink to the printhead, thereby regulating a hydrostatic pressure of the ink.

The present invention advantageously provides excellent regulation of hydrostatic ink pressure using bubble point pressure regulation. The hydrostatic ink pressure may be controlled to be at least 10 mm $H_2O$ less than atmospheric pressure, at least 25 mm $H_2O$ less than atmospheric pressure, at least 50 mm $H_2O$ less than atmospheric pressure or at least 100 mm $H_2O$ less than atmospheric pressure. Pressure regulation is achieved by dimensioning the regulator channel (and thereby the bubble outlet). For example, the regulator channel may have a critical depth dimension of less than 200 microns, less than 150 microns, less than 100 microns or less than 75 microns to achieve a requisite hydrostatic ink pressure during printing.

A particular advantage of the present invention is that the regulator channel remains wetted throughout the lifetime of the pressure regulator. This is achieved by the wetting system, which is comprised of first and second wetting chambers and the liquid-retaining structure.

Typically, the liquid is ink of the same type being supplied to the printhead.

Optionally, during use, the liquid retained by the wetting system is isolated from a reservoir of ink contained in the ink chamber.

The liquid-retaining structure is typically positioned in the second wetting chamber.

Optionally, the liquid-retaining structure is configured such that liquid from burst air bubbles is captured by the liquid-retaining structure. Hence, liquid from burst air bubbles is retained in the wetting system and does not escape into a body of ink via the headspace.

Optionally, the second wetting chamber is elongate and the liquid-retaining structure extends along a length of the second wetting chamber. This configuration advantageously promotes bubble bursting within the second wetting chamber and retention of liquid therein by the liquid-retaining structure.

Optionally, the liquid-retaining structure communicates with the headspace. Optionally, the liquid-retaining structure opens directly into the headspace. This arrangement advantageously facilitates entrapment of saturated ink vapour in the headspace by the liquid-retaining structure. Furthermore, ink is readily transferred to the liquid-retaining structure during transport or whenever the pressure regulator (which may be an ink cartridge) is tipped. This provides a useful mechanism by which the wetting system may be replenished with ink.

Optionally, the liquid-retaining structure retains the liquid by capillary action. Any structure with suitable curvature may be used to retain liquid by capillary action.

Optionally, the liquid-retaining structure is defined by one or more liquid-retaining apertures defined in a wall of the second wetting chamber, with the liquid-retaining apertures opening into the headspace.

Optionally, the liquid-retaining structure is defined by a plurality of slots defined in the wall of the second wetting chamber. The slots may extend along substantially the whole length of the second wetting chamber and open into the headspace.

Optionally, the liquid-retaining structure is a sponge. Likewise, the sponge may be elongate and extend along substantially the whole length of the second wetting chamber. The sponge may open into the headspace and absorb ink during transport or whenever the pressure regulator is tipped.

Optionally, the liquid-retaining structure comprises one or more liquid-retaining surface features defined in a wall of the second wetting chamber.

Optionally, the liquid-retaining structure comprises a plurality of grooves defined in a wall of the second wetting chamber.

Optionally, the first wetting chamber is open to atmosphere via the air inlet.

Optionally, the second wetting chamber has a vent opening into the headspace.

Optionally, the wetting chambers, the regulator channel and the liquid-retaining structure together retain a substantially constant volume of liquid.

Optionally, each wetting chamber is configured such that liquid is pinned into edge regions thereof, the edge regions being connected to the regulator channel.

Optionally, each wetting chamber is generally chamfered such that the edge regions comprise at least two chamber walls meeting at an acute angle.

Optionally, during idle periods, a positively pressurized headspace forces liquid to transfer from the second wetting chamber to the first wetting chamber.

Optionally, the positively pressurized air in the headspace escapes via the air inlet, having first passed through the liquid.

Optionally, the air inlet, the regulator channel and the wetting system are positioned in a roof of the ink chamber. This arrangement maximizes the volume of liquid that can be retained by the wetting system and also facilitates installment of the pressure regulator (which is typically a replaceable ink cartridge) in a printer.

Optionally, the pressure regulator defines an ink cartridge for an inkjet printer.

BRIEF DESCRIPTION OF THE DRAWINGS

Optional embodiments of the invention will now be described, by way of example only, with reference to the accompanying drawings, in which.

DETAILED DESCRIPTION OF OPTIONAL EMBODIMENTS

Pressure Regulator with Circular Bubble Outlet

Figure 1:
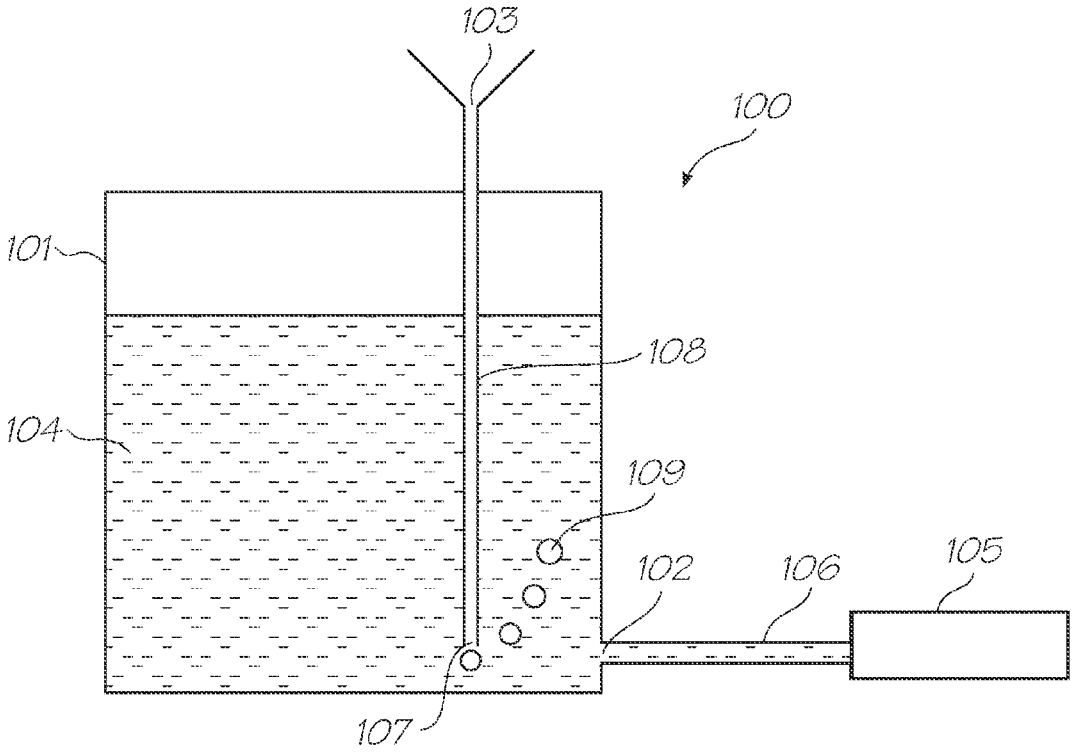
FIG. 1 is a schematic side section of a pressure regulator according to the present invention having a needle-like bubble outlet.

FIG. 1 shows the simplest form of the present invention, for the purposes of explaining the basic operating principle of the pressure regulator. In FIG. 1, there is shown a pressure regulator 100 comprising an ink chamber 101 having an ink outlet 102 and air inlet 103. The ink chamber 101 is otherwise sealed. The ink outlet 102 is for supplying ink 104 to a printhead 105 via an ink line 106. A bubble outlet 107 is connected to the air inlet 103 via an air channel 108.

When ink 104 is drawn from the ink chamber 101 by the printhead 105, the displaced volume of ink must be balanced with an equivalent volume of air, which is drawn into the chamber via the air inlet 103. The bubble outlet 107, which is positioned below the level of ink, ensures that the air enters the chamber 101 in the form of air bubbles 109. The dimensions of the bubble outlet 107 determine the size of the air bubbles 109 entering the chamber 101.

Figure 2:
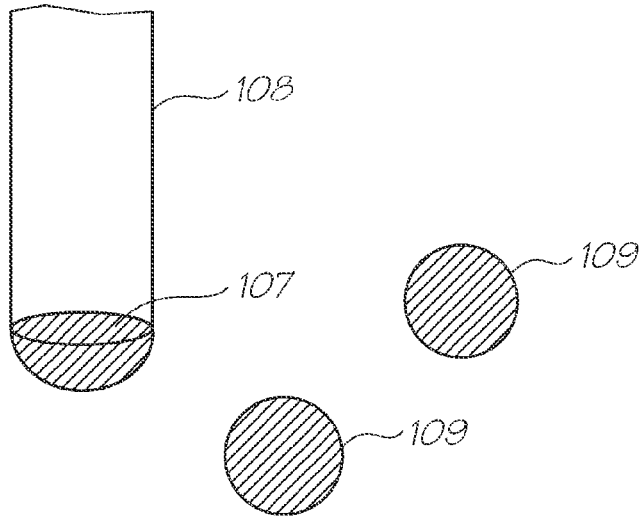
FIG. 2 is magnified view of the bubble outlet shown in FIG. 1.

As shown in FIG. 2, the air channel 108 takes the form of a simple cylindrical channel, so that the bubble outlet 107 is defined by a circular opening at one end of the cylindrical channel. Accordingly, any air passing through the channel must at some point be bounded by a liquid surface with radius of curvature not greater than the internal radius of the channel.

During printing, the nozzles on the printhead 105 effectively act as a pump, drawing ink from the ink chamber 101 with each drop ejection. If the ink chamber were left freely open to atmosphere with an air vent (as in some prior art ink cartridges), the hydrostatic ink pressure of the ink supplied to the printhead would be simply be the determined by the elevation of the ink reservoir above or below the printhead. However, in the ink chamber 101, each time a microscopic volume of ink is drawn from the chamber 101, it must overcome the pressure inside an air bubble 109 forming at the bubble outlet 107. Once the pumping effect of the nozzles generates sufficient pressure to match the pressure inside the air bubble 109 forming at the bubble outlet 107, then the air bubble can escape into the reservoir of ink 104 and ink can flow from the chamber 101 via the ink outlet 102.

Therefore, the air bubbles 109 forming at the bubble outlet 107 provide a back pressure against the pumping effect of the printhead nozzles. In other words, the effect of the bubble outlet 107 is to generate a negative hydrostatic ink pressure in the ink supply system.

The pressure inside the spherical air bubbles 109 is determined by the well-known Laplace equation:

$$\Delta P=2\gamma/r$$

where:

ΔP is the difference in pressure between the inside of the air bubble and the ink;

r is the radius of the air bubble; and

γ is the surface tension of the ink-air interface.

The size of the air bubbles 109 can be varied by varying the dimensions of the bubble outlet 107. Therefore, the dimensions of the bubble outlet 107 provides a means of establishing a predetermined negative hydrostatic pressure of ink supplied to the printhead 105. Smaller bubble outlet dimensions provide a larger negative hydrostatic ink pressure by virtue of generating smaller air bubbles having a higher Laplace pressure.

In the pressure regulator 100 described above, the air channel 108 is a small-bored cylinder (e.g. hypodermic needle) having a circular opening defining the bubble outlet 107. However, a significant problem with this design is that the circular bubble outlet 107 has a very small area (of the order of about 0.01 $mm^2$) and is susceptible to blockages by contaminants in the ink. It would be desirable to increase the area of the bubble outlet 107 so that it is more robust, even if there are contaminants in the ink.

Pressure Regulator with Slot-Shaped Bubble Outlet

Figure 3A:
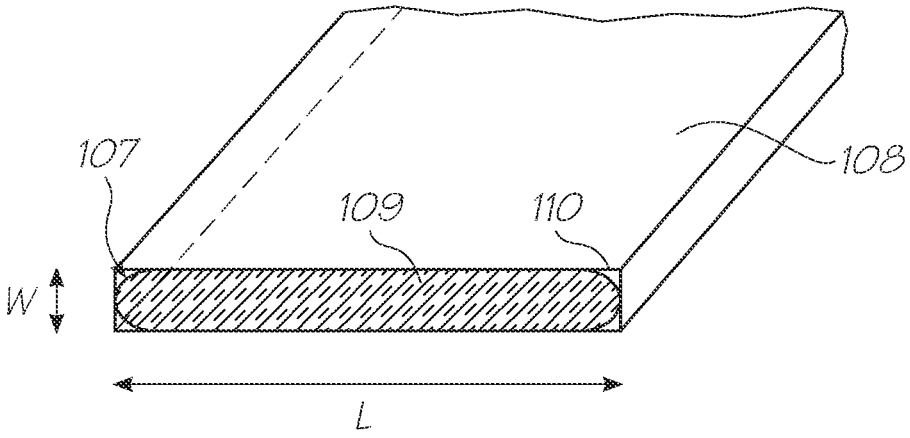
FIG. 3A is a schematic perspective view of a slot-shaped bubble outlet.

As shown in FIG. 3A, an improved design of bubble outlet 107 uses a slot 110, as opposed to a circular opening. The slot has a length dimension L and a width dimension W. The air bubbles 109 exiting the slot typically have a cylindrical front extending across the length of the slot. As explained below, the curvature of the air bubbles 109 exiting the slot and, hence, the Laplace pressure of the air bubbles, is determined primarily by the width dimension.

For non-spherical bubbles, the Laplace pressure is given by the expression:

$$\Delta P=\gamma/r_1+\gamma/r_2$$

where:

ΔP is the difference in pressure between the inside of the air bubble and the ink;

$r_1$ is the radius of a width dimension of the air bubble;

$r_2$ is the radius of a length dimension of the air bubble;

γ is the surface tension of the ink-air interface.

In practice, the length of the slot is much greater than the width ($r_2 >> r_1$), and so the Laplace pressure of the air bubbles exiting the slot with a cylindrical front becomes:

$$\Delta P=\gamma/r_1 \text{ or } 2\gamma/W \text{ (since } W=2r_1)$$

It will therefore be appreciated that the width of the slot 110 is the only critical dimension controlling the Laplace pressure of the air bubbles 109 exiting the slot.

Figure 3B:
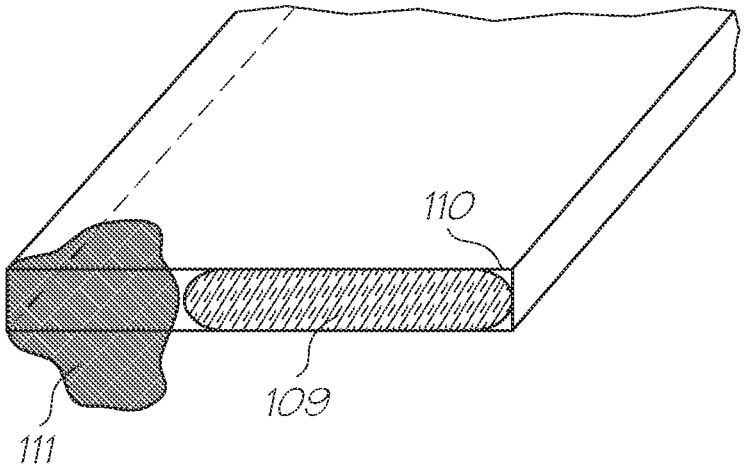
FIG. 3B shows the bubble outlet of FIG. 3A partially blocked with debris.

FIG. 3B shows a hypothetical scenario where a piece of debris 111 has become stuck to the slot 110. However, unlike the case of a circular opening, the slot 110 is still able to control the critical curvature of bubbles exiting the slot. An air bubble 109 having a cylindrical front can still exit the slot 110 as shown in FIG. 3B. Thus, the slot 110 provides a more robust design for the bubble outlet 107, whilst still maintaining excellent control of the hydrostatic ink pressure.

In the embodiments discussed so far, the dimensions of the air channel 108 mirror the dimensions of the bubble outlet 107. This is not an essential feature of the regulator and, in fact, may adversely affect the efficacy of the regulator, particularly at high flow rates. The inherent viscosity of air can cause a significant flow resistance or hydraulic drag in the air channel 108. According to Pouiseille's equation, flow rate has an $r^4$ relationship with pipe radius r. Hence, the problem of flow resistance is exacerbated in channels having very small radii.

In the present invention, a critical dimension of the bubble outlet 107 is optionally less than about 200 microns, or optionally less than about 150 microns, or optionally less than about 100 microns, or optionally less than about 75 microns or optionally less than about 50 microns. Optionally, the critical dimension of the bubble outlet may be in the range of 10 to 50 microns or 15 to 40 microns. By "critical dimension" it is meant the dimension of the bubble outlet determining the curvature and, hence, the Laplace pressure of the air bubbles.

Such dimensions are necessary to provide the desired negative hydrostatic ink pressure, which is optionally at least 10 $mmH_2O$, or optionally at least 30 $mmH_2O$, or optionally at least 50 $mmH_2O$ for a photo-sized printhead. For an A4-sized printhead, the desired negative hydrostatic ink pressure is optionally at least 100 $mmH_2O$, or optionally at least 200 $mmH_2O$, or optionally at least 300 $mmH_2O$. Optionally, the negative hydrostatic pressure may be in the range of 100 to 500 $mmH_2O$ or 150 to 450 $mmH_2O$ The air channel 108, having a width of, say, less than 200 microns, generates significant flow resistance for air entering the channel. If air is unable to pass through the channel 108 at the same flow rate as ink is supplied to the printhead 105, then a catastrophic deprime of the printhead would result at high print-speeds.

Accordingly, it is desirable to configure the air channel 108 so that each cross-sectional dimension of the air channel is larger than the critical dimension of the bubble outlet 107. So, for the slot-shaped bubble outlet 107 shown in FIG. 3A, the air channel 108 should optionally have each cross-sectional dimension greater than the width W of the slot 110.

However, it is important that the volume of the air channel 108 is not too large. When the printhead 105 is idle, ink may rise up the air channel 108 by capillary action. This volume of ink must be pulled through the air channel 108 by the printhead 105 before air bubbles 109 are drawn into the ink chamber 101 and the optimal hydrostatic ink pressure for printing is reached. Hence, a volume of ink drawn into the air channel 108 by capillary action during idle periods will be wasted, since it cannot be printed with optimal print quality.

The capillary volume of ink increases with the radius of the air channel. Accordingly, the cross-sectional dimensions (e.g. radius) of the air channel 108 should optionally not be so large that the maximum capillary volume exceeds about 0.1 mL of ink, which is effectively a dead volume of ink. Optionally, the maximum capillary volume of ink in the air channel is less than about 0.08 mL, or optionally less than about 0.05 mL, or optionally less than about 0.03 mL.

Figure 4:
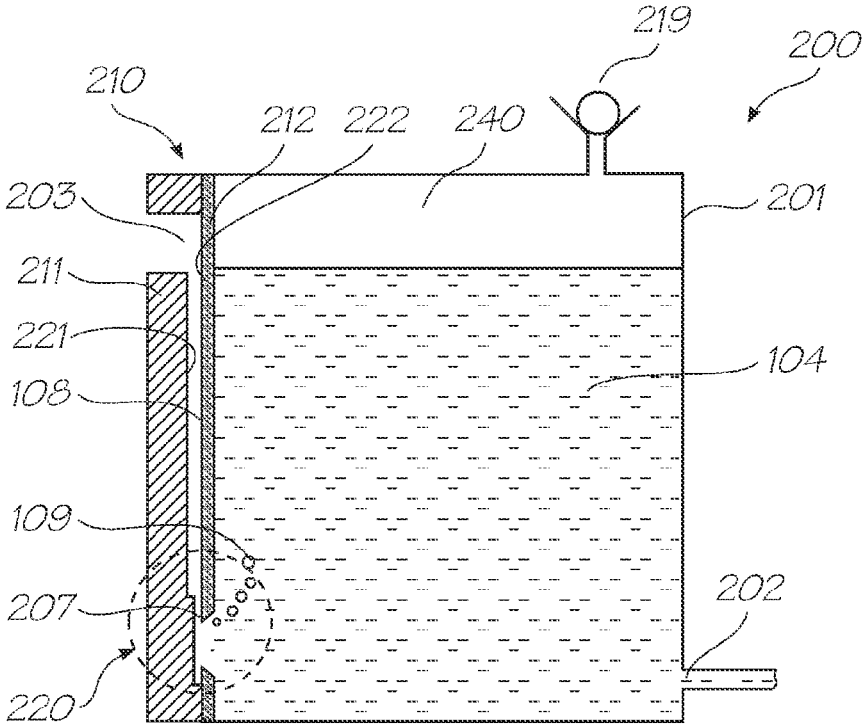
FIG. 4 is a schematic side section of a pressure regulator according to the present invention having a slot-shaped bubble outlet.

FIG. 4 shows an alternative ink pressure regulator 200 having a bubble outlet 207 and air channel 208 with the abovementioned design considerations taken into account. The pressure regulator 200 comprises an ink chamber 201 having an ink outlet 102. One sidewall of the ink chamber 201 is defined by a laminated air intake plate 210 comprising first and second planar layers 211 and 212. The first and second layers 211 and 212 have respective first and second faces 221 and 222 which cooperate to define the air inlet 203, the air channel 208 and the bubble outlet 207. The air inlet 203 may optionally comprise an air filter (not shown) for filtering particulates from air drawn into the ink chamber 201.

The ink chamber 201 also comprises a one-way pressure release valve 219, which is normally closed during operation of the pressure regulator 200. The valve 219 is configured to release any positive pressure in a headspace 240 above the ink 104, which may, for example, result from thermal expansion of a volume of air trapped in the headspace during typical day/night temperature fluctuations. A positive pressure in the headspace 240 is undesirable because it forces ink up the air channel 208 and out of the air inlet 203, leading to appreciable ink losses from the chamber 201.

Figure 6:
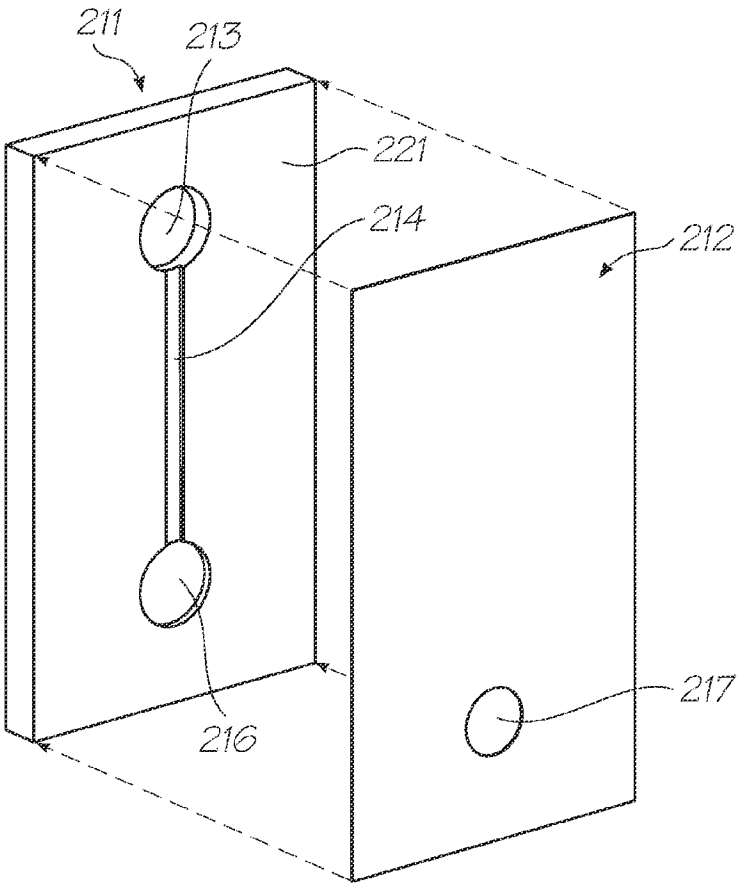
FIG. 6 is an exploded perspective view of the air intake plate shown in FIG. 4.

Referring to FIG. 6, the first layer 211 of the air intake plate 210 has an air inlet opening 213 defined therethrough and an elongate recess 214 in the form of a groove defined in the first face 221. The elongate recess 214 extends from the air inlet opening 213 to a recessed terminus region. The recessed terminus region comprises a circular recess 216 which has a relatively shallow depth compared to the elongate recess 214. Still referring to FIG. 6, the second layer 212 has a bubble vent opening 217 defined therethrough. As will be appreciated from FIGS. 4 and 6, when the first and second faces 221 and 222 are laminated together, the recesses and openings cooperate to define the air inlet 203, the air channel 208 and the bubble outlet 207.

Figure 5:
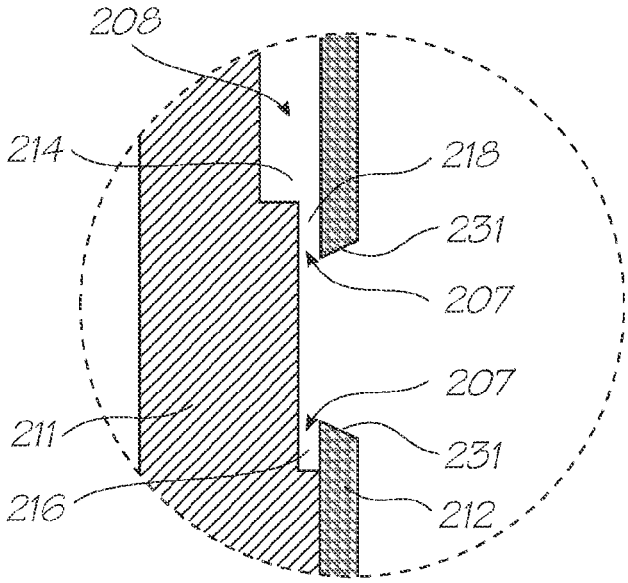
FIG. 5 is a magnified view of the bubble outlet shown in FIG. 4.

FIG. 5 shows in detail a bubble outlet region 220 of the air intake plate 210. The circular recess 216, being shallower than the elongate recess 214, defines a constriction 218 in the air channel 108. This constriction 218, defined by the depth of the circular recess 216 in the first face 221, defines a critical width dimension for the bubble outlet 207. The bubble outlet 207 therefore takes the form of an annular slot with a length of the slot being defined by a circumference of the bubble vent opening 217 in the second layer 212.

An advantage of having an annular slot is that it maximizes the length of the slot, thereby improving the robustness of the bubble outlet 207 to particulate contamination. An advantage of having a relatively deep elongate recess 214 is that it minimizes flow resistance in the air channel 108 defined by cooperation of the recess 214 and the second face 222. Typically, the elongate recess 214 has a depth in the range of 0.2 to 1 mm or 0.2 to 0.5 mm, and a width in the range of 0.5 to 2 mm or 0.7 to 1.3 mm.

Still referring to FIG. 5, it can be seen that inner faces 231 of the bubble vent opening 217 are beveled so as to optimize escape of bubbles from the bubble outlet 207.

Figure 7:
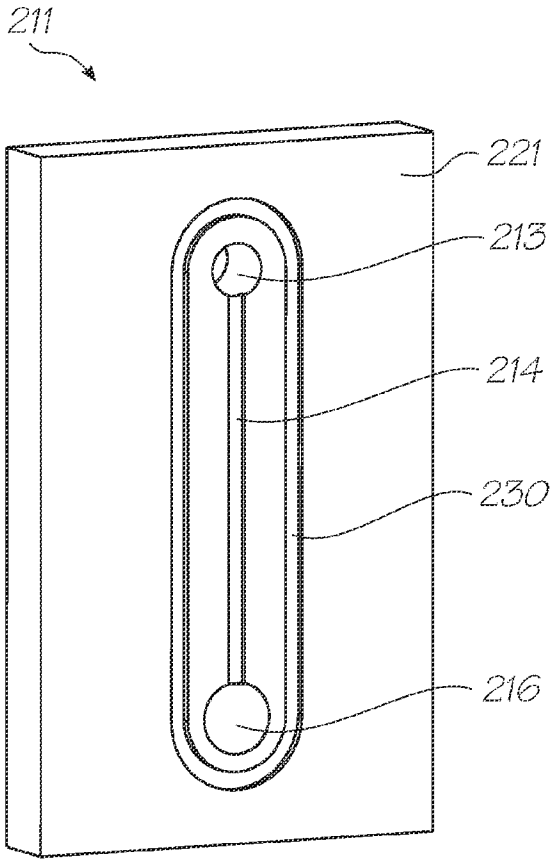
FIG. 7 is a perspective view of an alternative air intake plate with protective moat.

Referring to FIG. 7, the first layer 211 of the air intake plate 210 may have a moat 230 defined therein. The moat 230 surrounds the features defined in the first layer 211 and, importantly, protects the elongate recess 214 and circular recess 216 from any adhesive during the lamination process. The wicking of any excess adhesive between the first and second faces 221 and 222 is arrested by the moat 230 as capillary action can only transport liquids into of structures ever decreasing dimensions, and any path across the moat includes a region of increasing dimension. This prevents blocking of the air inlet channel 208 or the bubble outlet opening 207, which are defined by lamination of the two layers. Hence, the moat 230 is a feature, which facilitates manufacture of the air intake plate 210.

Figure 8:
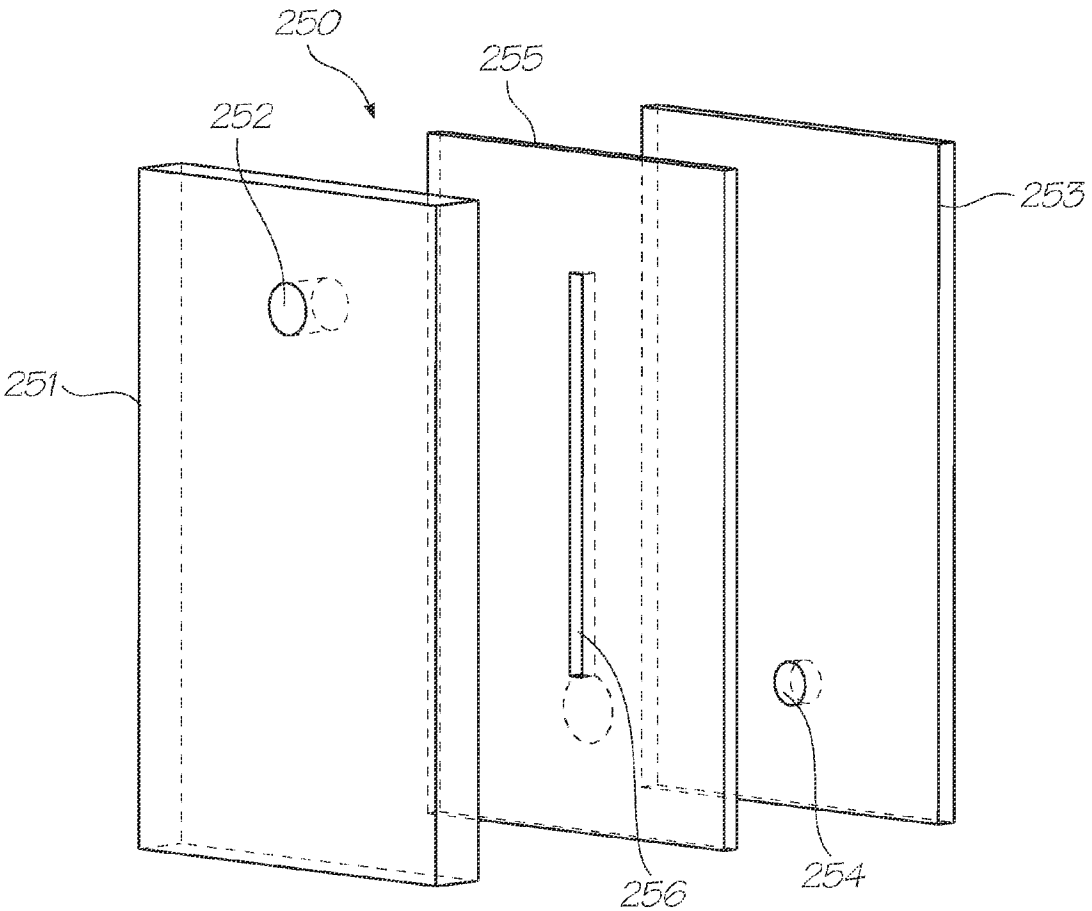
FIG. 8 is an exploded perspective view of an alternative tri-layered air intake plate.

Of course, it will be appreciated that the air intake plate may take many different forms and may, for example, be defined by cooperation of more than two laminated layers. FIG. 8 shows an air intake plate 250 defined by cooperation of three layers. A first layer 251 has an air inlet opening 252 defined therethrough; a second layer 253 has an bubble vent opening 254 defined therethrough; and a third film layer 255 is sandwiched between the first and second layers. The film layer 255 has an air channel opening 256 defined therethrough, so that when the three layers are laminated together a fluidic path is defined from an air inlet to the bubble vent. The thickness of the film layer 255 defines the depth of the air channel and the critical dimension of the bubble outlet at the terminus of the air channel.

Tables 1 to 4 below show measured hydrostatic ink pressures for the pressure regulator 200 shown in FIGS. 4 to 6. Four pressure regulators were constructed having different critical dimensions of the bubble outlet 207. Dynamic pressure measurements were made at various flow rates and static pressure measurements were made by stopping the flow of ink. The dynamic pressure loss is the difference between the dynamic regulating pressure and the static regulating pressure.

TABLE 1

35 micron bubble outlet

| Flow Rate (ml/sec) | Dynamic Regulating Pressure (mm $H_2O$) | Static Regulating Pressure (mm $H_2O$) | Dynamic Pressure Loss (mm $H_2O$) |
|---|---|---|---|
| 0.05 | −203 | −178 | −25 |
| 0.04 | −196 | −175 | −21 |
| 0.03 | −194 | −178 | −16 |
| 0.02 | −189 | −173 | −16 |
| 0.01 | −185 | −175 | −10 |
| 0.005 | −172 | −165 | −7 |
| | | −174 (Average) | |

TABLE 2

70 micron bubble outlet

| Flow Rate (ml/sec) | Dynamic Regulating Pressure (mm $H_2O$) | Static Regulating Pressure (mm $H_2O$) | Dynamic Pressure Loss (mm $H_2O$) |
|---|---|---|---|
| 0.05 | −110 | −84 | −26 |
| 0.04 | −104 | −79 | −25 |
| 0.03 | −100 | −84 | −16 |
| 0.02 | −91 | −79 | −12 |
| 0.01 | −84 | −83 | −1 |
| 0.005 | −80 | −76 | −4 |
| | | −81 (Average) | |

TABLE 3

105 micron bubble outlet

| Flow Rate (ml/sec) | Dynamic Regulating Pressure (mm $H_2O$) | Static Regulating Pressure (mm $H_2O$) | Dynamic Pressure Loss (mm $H_2O$) |
|---|---|---|---|
| 0.05 | −65 | −38 | −27 |
| 0.04 | −65 | −44 | −21 |
| 0.03 | −56 | −40 | −16 |
| 0.02 | −51 | −38 | −13 |
| 0.01 | −43 | −38 | −5 |
| 0.005 | −38 | −36 | −2 |
| | | −39 (Average) | |

TABLE 4

140 micron bubble outlet

| Flow Rate (ml/sec) | Dynamic Regulating Pressure (mm $H_2O$) | Static Regulating Pressure (mm $H_2O$) | Dynamic Pressure Loss (mm $H_2O$) |
|---|---|---|---|
| 0.05 | −60 | −32 | −28 |
| 0.04 | −56 | −34 | −22 |
| 0.03 | −54 | −36 | −18 |
| 0.02 | −51 | −37 | −14 |
| 0.01 | −38 | −34 | −4 |
| 0.005 | −34 | −31 | −3 |
| | | −34 (Average) | |

Excellent control of ink pressure was achievable simply by varying the dimensions of the bubble outlet.

Moreover, the pressure measurements confirmed that the air bubbles were being generated in accordance with the Laplace equation. The average static regulating pressures were found to obey the equation:

$$P=-0.0067/W+18.3$$

where:

P is the average static regulating pressure in millimeters of water head;

W is the width of the bubble outlet in micron; and 18.3 is an offset pressure due to the level of ink in the chamber.

Substituting the first term into the Laplace equation, the surface tension γ of the ink was calculated as 33.5 mN/m. Independent surface tension measurements of the ink correlated well with this calculated figure.

Ink Cartridge Comprising Pressure Regulator

As shown in FIG. 4, the pressure regulator 200 comprises an ink chamber 201, which defines an ink reservoir for the printhead. Due to the simplicity and low-cost manufacture of the pressure regulator 200, it may be constructed as a replaceable ink cartridge for an inkjet printer. Hence, each time the ink cartridge is replaced, the pressure regulator is replaced. An advantage of this design is that long-term fouling of the pressure regulator 200 is avoided, because it is periodically replaced during the lifetime of the printer.

Replaceable Ink Cartridge Connected to Pressure Regulator

In an alternative embodiment, the pressure regulator may be a permanent component of a printer. In this alternative embodiment, the pressure regulator is configured for connection to a replaceable ink cartridge. Hence, in the embodiment shown in FIG. 9, the pressure regulator 200 is connected to a replaceable ink cartridge 280 via a pair of connectors. An ink connector 281 connects an ink supply port 282 of the ink cartridge 280 with an ink inlet port 283 of the ink chamber 201. The ink supply port 282 and corresponding ink inlet port 283 are positioned towards a base of the ink cartridge 280 and ink chamber 201 respectively, to maximize usage of ink 104 stored in the cartridge.

A pressure-equalizing connector 285 is positioned to equalize pressure in the headspace 240 of the ink chamber 201 and a headspace 241 of the ink cartridge 280. Corresponding pressure-equalizing ports 286 and 287 are positioned towards a roof of the ink chamber 201 and ink cartridge 280, respectively.

When the ink cartridge 280 is empty, it is disconnected from the ink connector 281 and the pressure-equalizing connector 285, and removed from the printer. A new ink cartridge can then be installed in the printer by the reverse process. Although only shown schematically in FIG. 9, it will be readily appreciated that the ink cartridge 280 may have suitable connection ports 282 and 287, which are configured for sealing engagement with the ink connector 281 and pressure-equalizing connector 285, respectively, when the ink cartridge is installed in the printer. Connection ports suitable for such sealing engagement are well known in the art.

Figure 9:
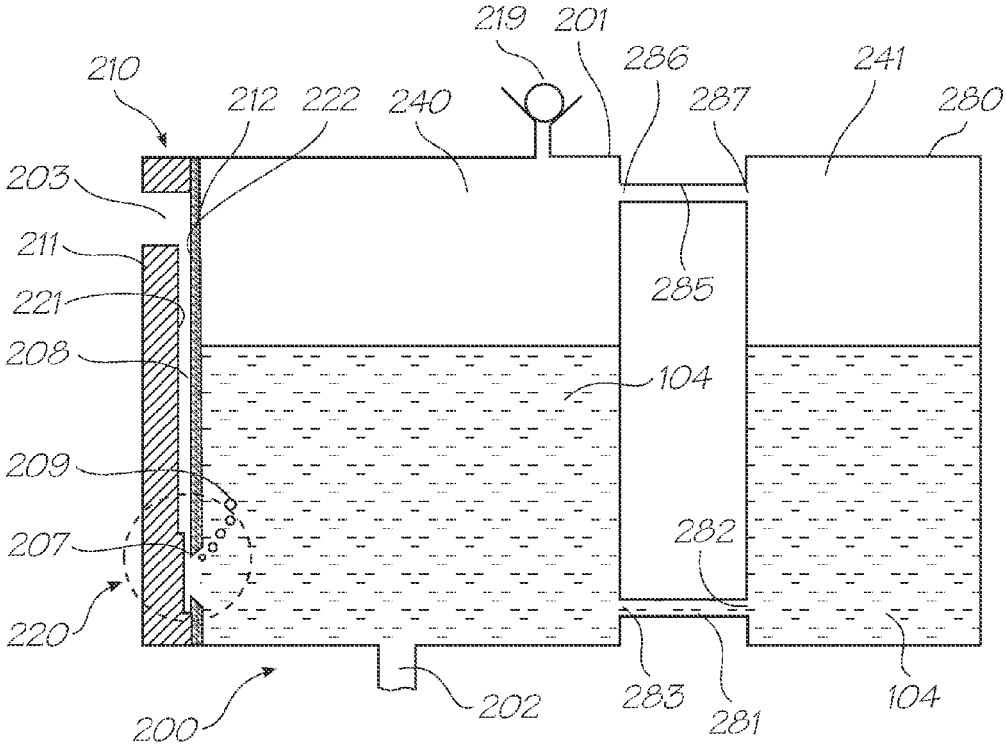
FIG. 9 is a schematic side section of the pressure regulator shown in FIG. 4 connected to a separate ink cartridge.

As shown in FIG. 9 the ink inlet port 283 and pressure-equalizing port 286 are defined in a sidewall of the ink chamber 201 which is opposite to the air intake plate 210. However, the ports 283 and 286, may of course be defined in the air intake plate 210 so as to simplify construction of the pressure regulator 200.

Bubble Outlet Positioned in Headspace with Capillary Supply of Ink

In the pressure regulator described in FIG. 4, the bubble outlet 207 is positioned so as to bubble air bubbles 209 into a body of ink 104 contained in the ink chamber 201. Typically, the bubble outlet 207 is positioned towards a base of the chamber 201 in order to maximize ink usage at optimal hydrostatic pressure, with the air inlet 203 being positioned towards a roof of the chamber. A problem with this arrangement is that ink 104 contained in the chamber 201 can easily escape up the air channel 208 and out of the air inlet 203 during idle periods as a consequence of temperature fluctuations, whereby heating air in the headspace 240 increase the headspace pressure and forces ink up the air channel 208 and out of the air inlet 203. Such temperature fluctuations are unavoidable and can result in significant ink wastage.

As already alluded to above, one means of addressing this problem is by incorporating a pressure-release valve 219 into the ink chamber 201. This valve 219 is configured to release any positive pressure in the headspace 240. However, valves of this type add significantly to the cost and complexity of the pressure regulator. Hence, the pressure-release valve 219 makes the pressure regulator 200 less amenable for incorporation into a disposable ink cartridge.

It would therefore be desirable to provide an ink pressure regulator, which does waste quantities of ink during temperature fluctuations and does not require a pressure-release valve, and which is therefore more amenable for incorporation into a disposable ink cartridge.

Figure 10:
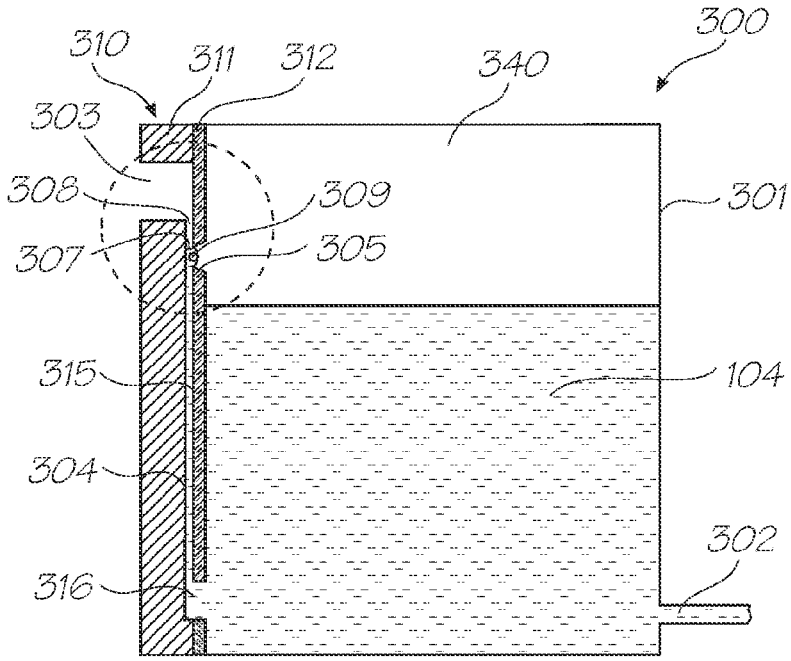
FIG. 10 is a schematic side section of a pressure regulator with bubble outlet positioned for bubbling air bubbles into a headspace and capillary supply of ink to the bubble outlet.

FIG. 10 shows an ink pressure regulator 300, which meets the above-mentioned criteria. The ink pressure regulator is similar in design to that shown in FIG. 4 and still relies on controlling the Laplace pressure of air bubbles entering the ink chamber. However, rather than air bubbles bubbling into a body of ink contained in the chamber, the air bubbles enter the chamber via the headspace above the body of the ink. This design enables any excess pressure in the headspace to vent through the air inlet during idle periods, as will be explained in more detail below.

Referring to FIG. 10, the ink pressure regulator 300 comprises an ink chamber 301 having an ink outlet 302. One sidewall of the ink chamber 301 is defined by a laminated air intake plate 310 comprising first and second planar layers 311 and 312, which cooperate to define an air inlet 303, a bubble outlet 307, a bubble vent 305, an air (or regulator) channel 308, a capillary channel 315 and a capillary inlet 316. The bubble outlet 307 and bubble vent 305 are positioned above the level of ink in the chamber 301 so that air bubbles 309 enter the headspace 340 of the chamber via the bubble vent. The bubble outlet 307 is connected to the air inlet 303 via the air channel 308. The bubble outlet 307 is generally slot-shaped and is critically dimensioned to control the Laplace pressure of air bubbles 309 as ink is drawn from the ink outlet 302.

Figure 11:
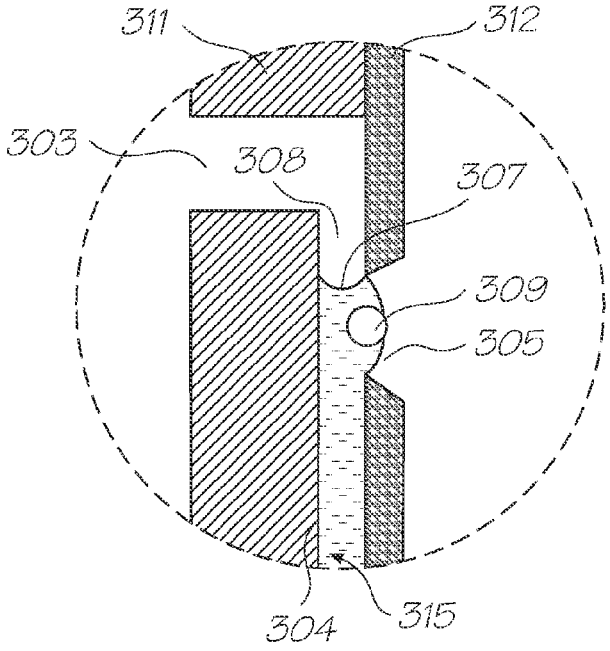
FIG. 11 is a magnified view of the bubble outlet shown in FIG. 10 during printing.

However, in contrast to previous embodiments, the air bubbles 309 are formed by air breaking through a meniscus of ink pinned across the bubble outlet 307 and adjacent bubble vent 305, as shown more clearly in FIG. 11. The so-formed air bubbles 309 emerging from the bubble outlet 307 escape through the bubble vent 305 and into the headspace 340 of the ink chamber 301. Since the air must break through an ink meniscus, the air bubbles 309 are defined by an air cavity trapped inside a film of ink, rather than a whole body of ink. Regardless, the same Laplacian pressure control is still achievable, as described above.

The capillary inlet 316 provides fluid communication between the body of ink 104 in the chamber 301 and the capillary channel 315 defined between the two layers 311 and 312. The capillary channel 315 is configured to provide sufficient capillary pressure such that a column of ink 304 rises up the channel at least as high as the bubble outlet 307, thereby ensuring formation of air bubbles 309 by air breaking through a meniscus of ink. The capillary pressure is sufficiently high to re-form a meniscus across the bubble outlet 307 and bubble vent 305 after each air bubble 309 has vented into the headspace 340.

Figure 12:
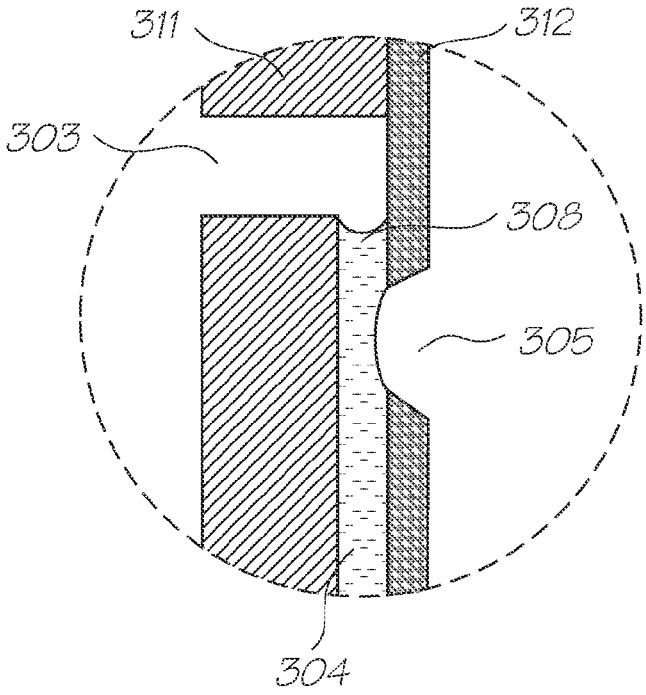
FIG. 12 is a magnified view of the bubble outlet shown in FIG. 10 during an idle period.

The bubble vent 305 is dimensioned such that the column of ink 304 has a meniscus pinned across the vent by surface tension, as shown in FIGS. 11 and 12. However, the bubble vent 305 should not be so small that it is susceptible to blockage by particulates. A bubble vent 305 having a diameter of the order of about 1 mm has been found to be suitable.

In practice, during idle periods when there is no significant pressure in the headspace 340 of the ink chamber 301, the column of ink 304 rises above the bubble outlet 307 and typically pins across the entrance to the air channel 308, as shown in FIG. 12.

Figure 13:
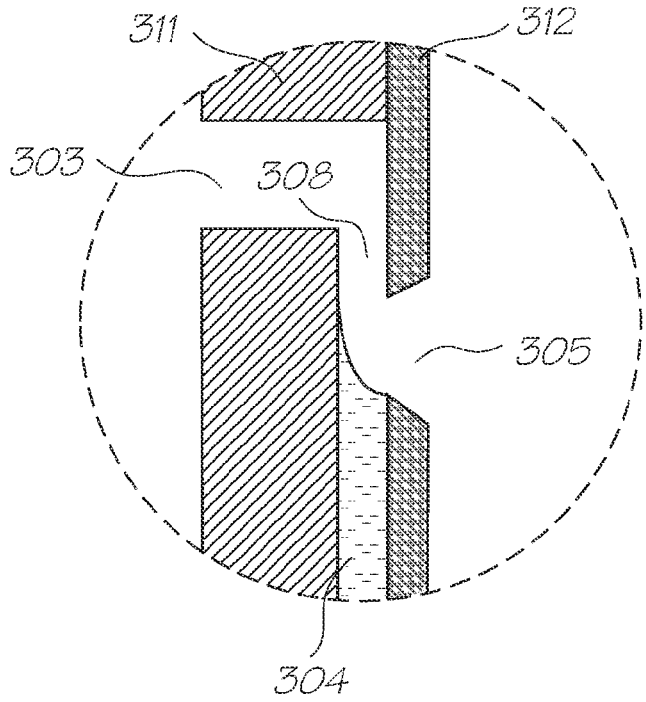
FIG. 13 is a magnified view of the bubble outlet shown in FIG. 10 during an instant when the headspace is venting after having been positively pressurized.
Figure 14:
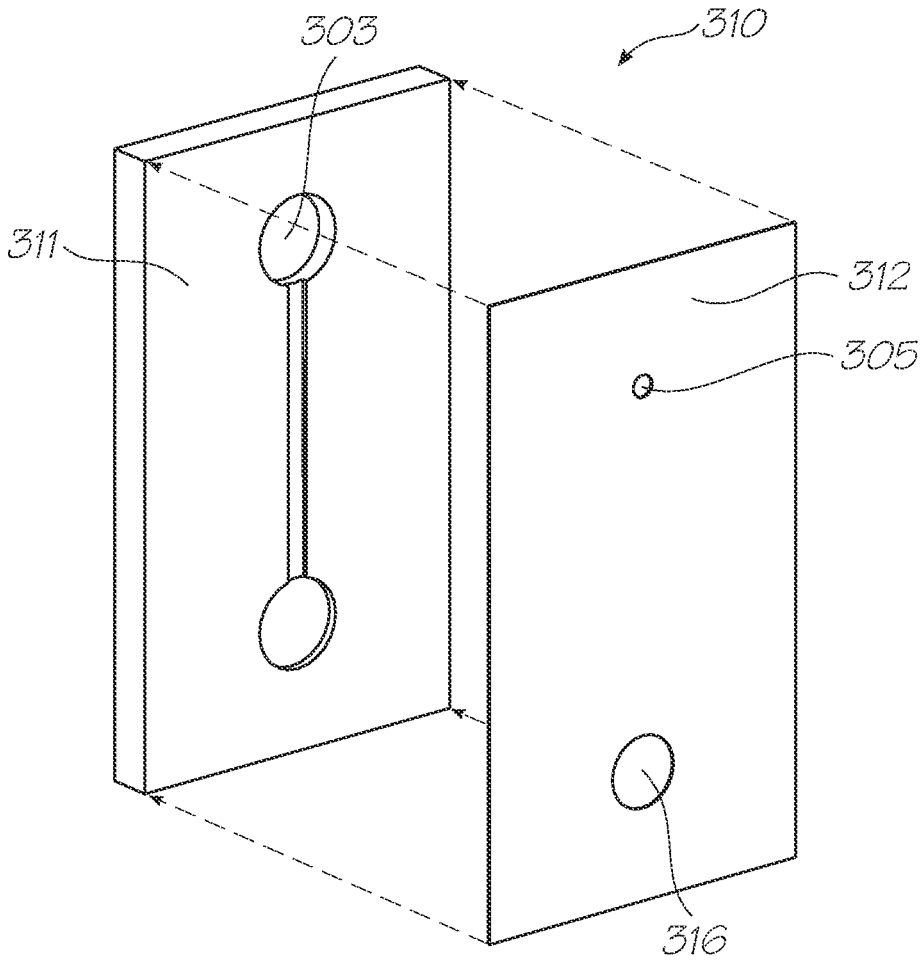
FIG. 14 is an exploded perspective view of the air intake plate shown in FIG. 10.

A significant advantage of the present embodiment is demonstrated in FIG. 13. FIG. 13 shows the situation where a positive pressure is built up in the headspace 340 during an idle period. The pressurized air forces any ink from the air channel 308 and the air escapes from the chamber 301 via the air inlet 303. Accordingly, only minute quantities of ink escape from the chamber 301 when the headspace 340 becomes pressurized due to temperature rises.

A further advantage of the present embodiment is that the air channel 308 is relatively short, thereby minimizing any flow resistance in the air channel and allowing high flow rates of ink from the chamber 301 with optimal pressure control. Any flow resistance problems (such as those described above in connection with the embodiment shown in FIG. 4) are therefore avoided.

Bubble Outlet Venting into Headspace and Isolated from Body of Ink

In the embodiment described above in connection with FIGS. 10 to 14, the bubble outlet 307 and bubble vent 308 are positioned in the headspace 340 of the pressure regulator 300. As shown in FIG. 13, this arrangement helps to minimize ink leakages via the air inlet 303 due to pressure fluctuations of the headspace.

However, even with the pressure regulator 300 configured in this way, there is still a mechanism by which ink 104 in the chamber 301 can escape. Since the capillary channel 315 provides fluidic communication between the air inlet 303 and the body of ink 104, then it is possible for ink to be pumped up the capillary channel by positive headspace pressure. If ink is pumped up the capillary channel 315, this negates the venting mechanism shown in FIG. 13 and significant ink losses may still result. It would be therefore be desirable to provide an ink pressure regulator, whereby ink losses due to temperature/pressure fluctuations in the headspace are further minimized.

FIGS. 15 to 19 show an ink pressure regulator 400, which addresses the problem of ink losses via the air inlet. The pressure regulator comprises an ink chamber 401, which contains a reservoir of ink 104, and an ink outlet 402 for supplying ink to a printhead. Pressure regulation is achieved similarly to the embodiment described above. Hence, air bubbles having a predetermined Laplace pressure exit from a bubble outlet and vent into a headspace 440 by breaking through a meniscus of ink. However, unlike the embodiment shown in FIG. 10, the bubble outlet and air inlet are fluidically isolated from the body of ink 104 contained in the chamber 401 during normal use. This ensures minimal ink losses when the pressure regulator 400 is used in a printer. Prior to installation in a printer (e.g. during transit), all inlet and outlet ports in the chamber 401 may be plugged to prevent ink leakages.

Figure 15:
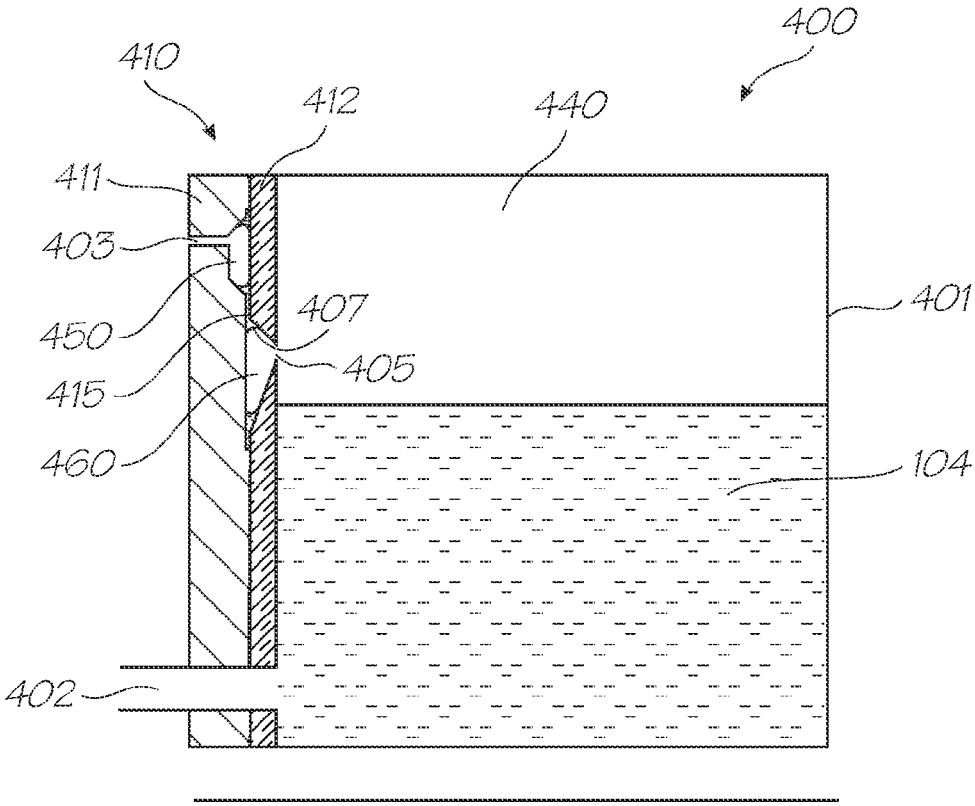
FIG. 15 is a schematic side section of a pressure regulator with a fluidically isolated wetting system for a regulator channel.

Referring to FIG. 15, a sidewall of the ink chamber 401 is defined by a laminated air intake plate 410 comprising first and second planar layers 411 and 412. These planar layers cooperate to define first and second wetting chambers 450 and 460, interconnected by a regulator channel 415. The regulator channel 415 defines a bubble outlet 407 at one end and is therefore critically dimensioned to control the Laplace pressure of air bubbles exiting the bubble outlet.

The first wetting chamber 450 is open to atmosphere via an air inlet 403, whilst the second wetting chamber 460 opens into the headspace 440 of the ink chamber 401 via a vent 405.

The first and second wetting chambers 450 and 460 together retain a constant volume of liquid (typically ink) and function to ensure that the regulator channel 415 remains wetted at all times. (This function was performed by the capillary channel 315 in the embodiment described above). It is, of course, crucial that the regulator channel 415 and bubble outlet 407 are never dry when the regulator is required for printing operations, otherwise air can simply stream into the headspace 440 and pressure regulation fails.

Ink is transferable between the first and second wetting chambers 450 and 460 via the regulator channel 415. Hence, a volume of ink retained in each of the first and second wetting chambers 450 and 460 may vary depending on whether the bubble regulator 400 is supplying ink to a connected printhead during printing, or whether the bubble regulator is idle.

Figure 16:
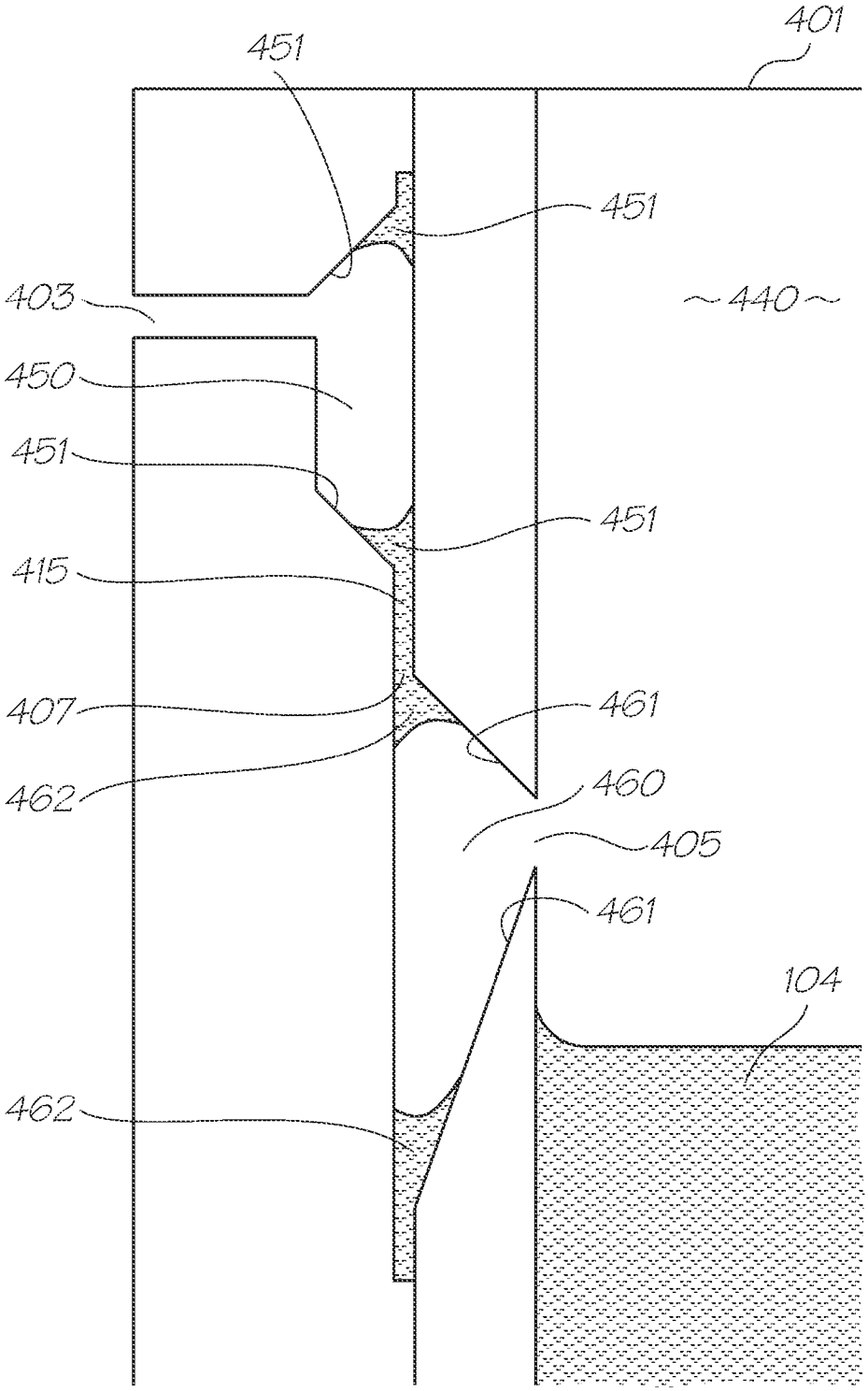
FIG. 16 is a magnified view of the regulator channel shown in FIG. 15 during an idle period.

Referring now to FIG. 16, there is shown a magnified view of the regulator channel 415, first wetting chamber 450 and second wetting chamber 460 during an idle period. Each wetting chamber has tapered walls 451 and 461. In the first wetting chamber 450, the walls 451 taper towards the air inlet 403; in the second wetting chamber 460, the walls 461 taper towards the vent 405. This tapering (or chamfering) ensures that ink is retained in each chamber. The ink is pinned into edge regions of each chamber by surface tension, forming an annulus of ink at a perimeter of each chamber. A first annulus of ink 452 retained in the first wetting chamber 450 fluidically communicates with a second annulus of ink 462 retained in the second wetting chamber 460 via the regulator channel 415. Accordingly, as the volume of the first annulus 452 decreases, the volume of the second annulus 462 will correspondingly increase, and vice versa. This transfer of ink between the first and second wetting chambers 450 and 460 enables the pressure regulator to achieve a pressure regulation, whilst minimizing ink leakage as will be explained in more detail below.

Figure 17:
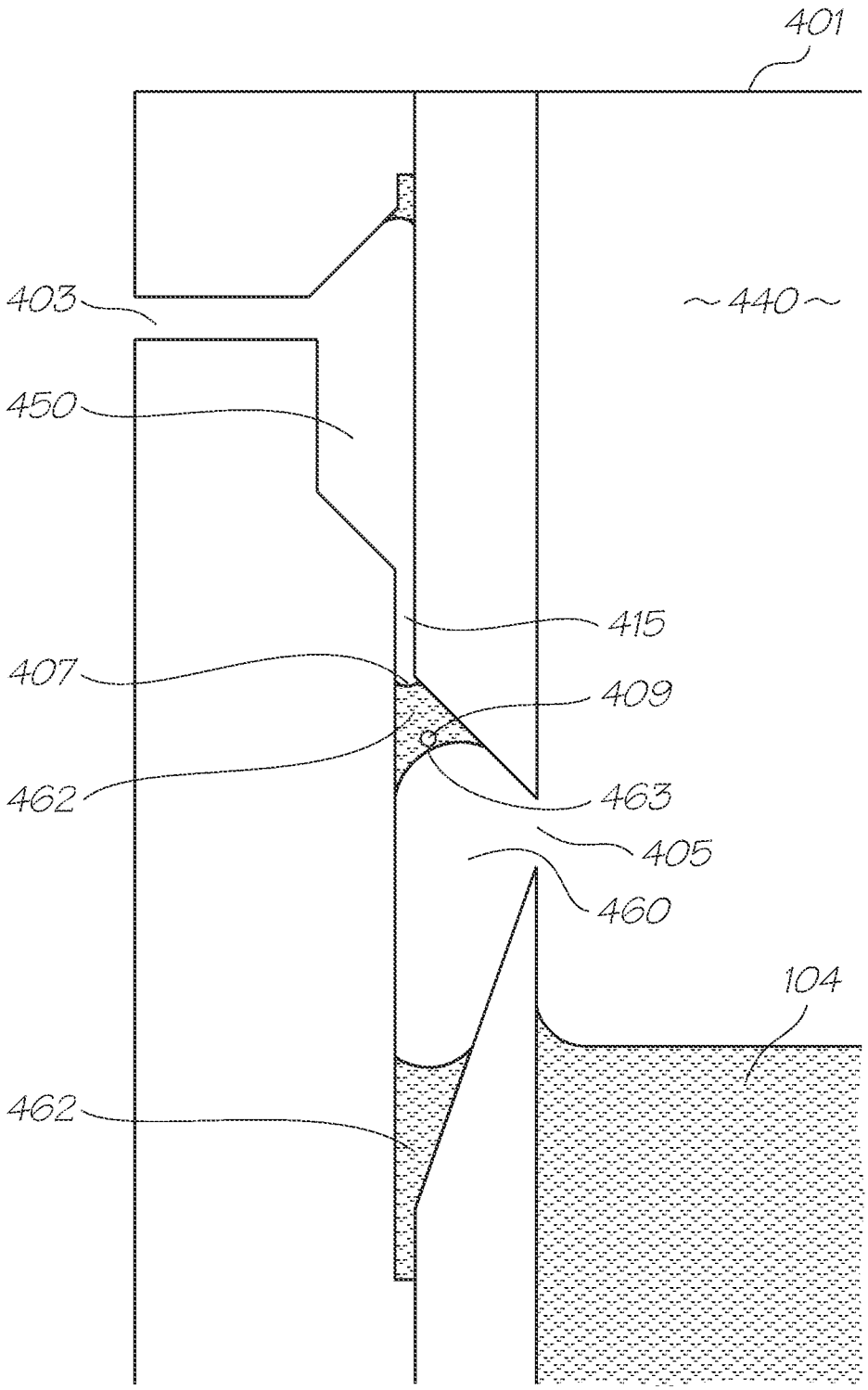
FIG. 17 is a magnified view of the regulator channel shown in FIG. 15 during printing.

Referring to FIG. 17, there is shown a magnified view of the regulator channel 415 and wetting chambers during printing. A pumping action of a printhead (not shown) connected to the ink outlet 403 draws air into the air inlet 403. The air pushes ink from the first wetting chamber 450 down the regulator channel 415 and into the second wetting chamber 460. Hence, the volume of the second annulus 462 increases relative to the first annulus 452. At the bubble outlet 407, which is the junction of the regulator channel 415 and the second wetting chamber 350, an air bubble 409 is formed and entrains into the second annulus 462 of ink. This bubble escapes from the second annulus 462 and into the headspace 440 by breaking through a meniscus 463 of the second annulus. The curvature of the air bubble 409 is determined by the dimensions of the regulator channel 415 and, hence, pressure regulation is achieved by the same mechanism described above.

Figure 18:
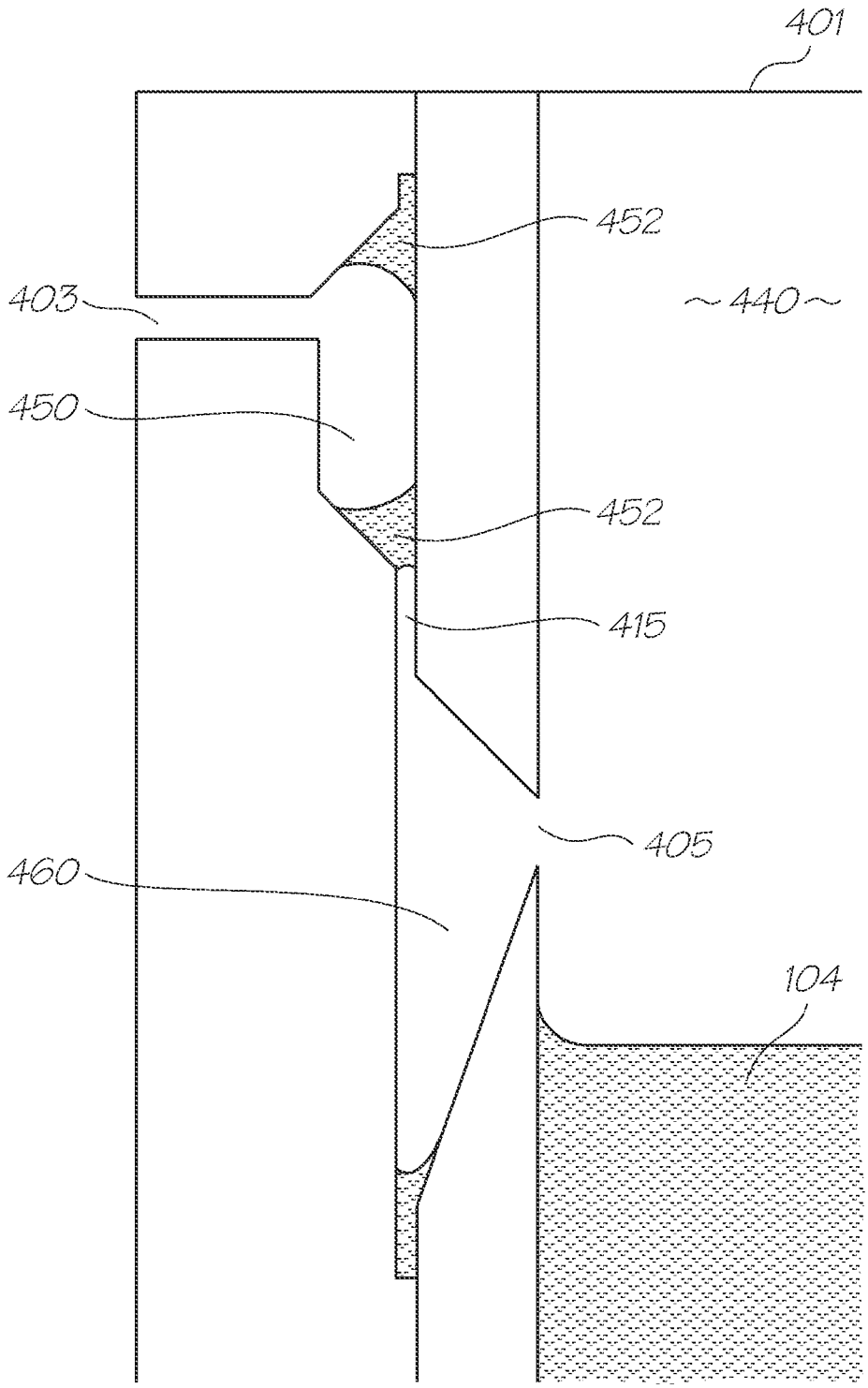
FIG. 18 is a magnified view of the regulator channel shown in FIG. 15 when the headspace is positively pressurized.

Referring to FIG. 18, there is shown the situation where the headspace 440 is positively pressurized due to an increase in temperature. In this scenario, air from the headspace 440 pushes ink from the second wetting chamber 460, up the regulator channel 415 and into the first wetting chamber 450. The volume of the first annulus 452 of ink retained by the first wetting chamber 450 increases as a result. However, the first wetting chamber 450 is sufficiently large to accommodate this increased volume of ink, so that ink cannot escape through the air inlet 403. Moreover, the pressurized air from the headspace 440 vents from the air inlet 403 by bubbling through the first annulus 452 of ink. In this way, minimal or no ink losses result from day/night or other temperature fluctuations.

Evaporation represents one mechanism by which liquid retained by the first and second wetting chambers may be lost. However, since the headspace 440 is in equilibrium with both the body of ink 104 and the ink retained in the wetting chambers, any water lost through evaporation is recovered relatively quickly by water vapour in the headspace. The headspace 440 will always have a humidity approaching 100% provided that the ink chamber 401 is not empty.

Figure 19:
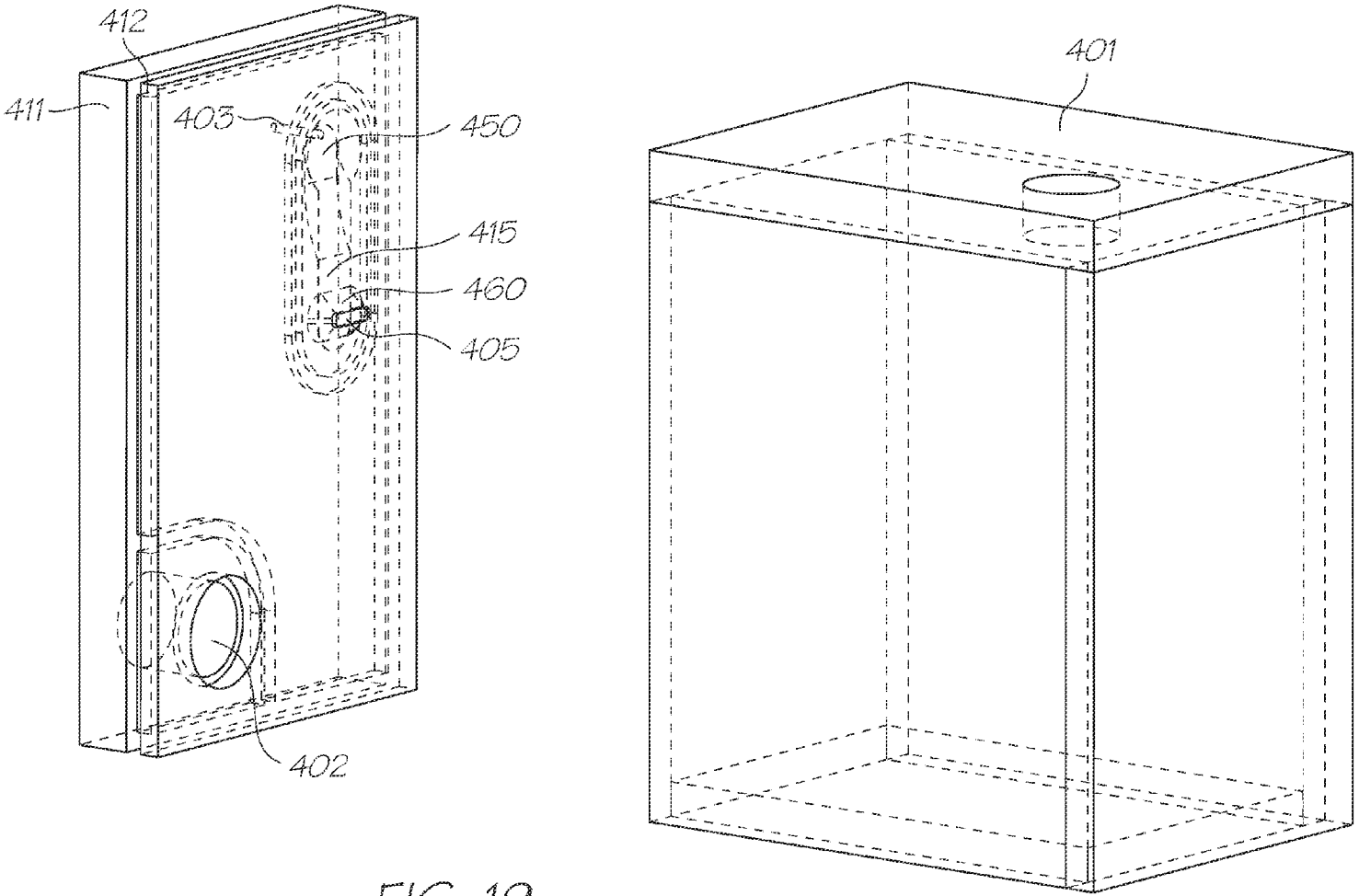
FIG. 19 is a cutaway perspective view of the pressure regulator shown in FIG. 15.

The first and second wetting chambers 450 and 460 may have any suitable configuration, provided that they are able to retain a volume of liquid using surface tension. Referring to FIG. 19, it can be seen that, in plan view, the first wetting chamber 450 is generally circular (i.e. substantially frustoconical) and the second wetting chamber 460 is generally rectangular (i.e. substantially frustopyramidal). A substantially frustopyramidal second wetting chamber 460 has been found, experimentally, to be particularly advantageous in avoiding ink losses.

The ink pressure regulator 400 as described above may define an ink cartridge for an inkjet printhead. Alternatively, a pressure regulating device comprising the first wetting chamber 450, the regulator channel 415 and the second wetting chamber 460 may be manufactured separately and fitted to an ink cartridge, as appropriate.

It will be recognized that an advantageous feature of the ink pressure regulator 400 is that the pressure regulating components are isolated fluidically from the reservoir of ink contained in an ink cartridge.

Improved Robustness for Bubble Outlet Venting into Headspace

The pressure regulator 400 described above exhibits excellent pressure regulation. Furthermore, the wetting chambers 450 and 460 ensure that the regulator channel 415 remains wetted and ready for use, even after typical day-night thermal cycling. However, it is critical that the pressure regulator maintains pressure regulation over its whole lifetime, which may be several months. When subjected to rigorous thermal cycling and ink supply tests, some liquid losses from the wetting chambers 450 and 460 was still observed. Although these losses were small, there is still a possibility of failure if the pressure regulator is used for long periods without replacement.

Evaporation via the air inlet 403 is one potential source of liquid losses. Another potential source of liquid loss is from air bubbles bursting in the second wetting chamber 460. Each time an air bubble bursts (during ink supply from ink outlet 402), a microscopic quantity of liquid is potentially removed from the wetting chambers if that liquid is not captured and recycled back into the wetting chambers.

Accordingly, the present inventors have sought measures, which address these issues in order to improve the overall lifetime and robustness of the pressure regulator. In an improved pressure regulator, the second wetting chamber incorporates a liquid-retaining structure. The advantages of incorporating a liquid-retaining structure are twofold. Firstly, it increases the overall volume of liquid held between the wetting chambers. This volume may be increased by at least 5 times, 10 times or 20 times compared with the pressure regulator 400 and, hence, any liquid losses that may be occurring in the system will not result in rapid failure of pressure regulation. Secondly, the liquid-retaining structure is typically configured to ensure that any liquid resulting from air bubbles bursting in the second wetting chamber is captured and recycled back into the wetting system.

The liquid-retaining structure typically retains liquid by capillary action and may take the form of apertures (e.g. slots) or surface formations (e.g. grooves) defined in a wall of the second wetting chamber. Alternatively, the liquid-retaining structure may take the form of a sponge.

Figure 20:
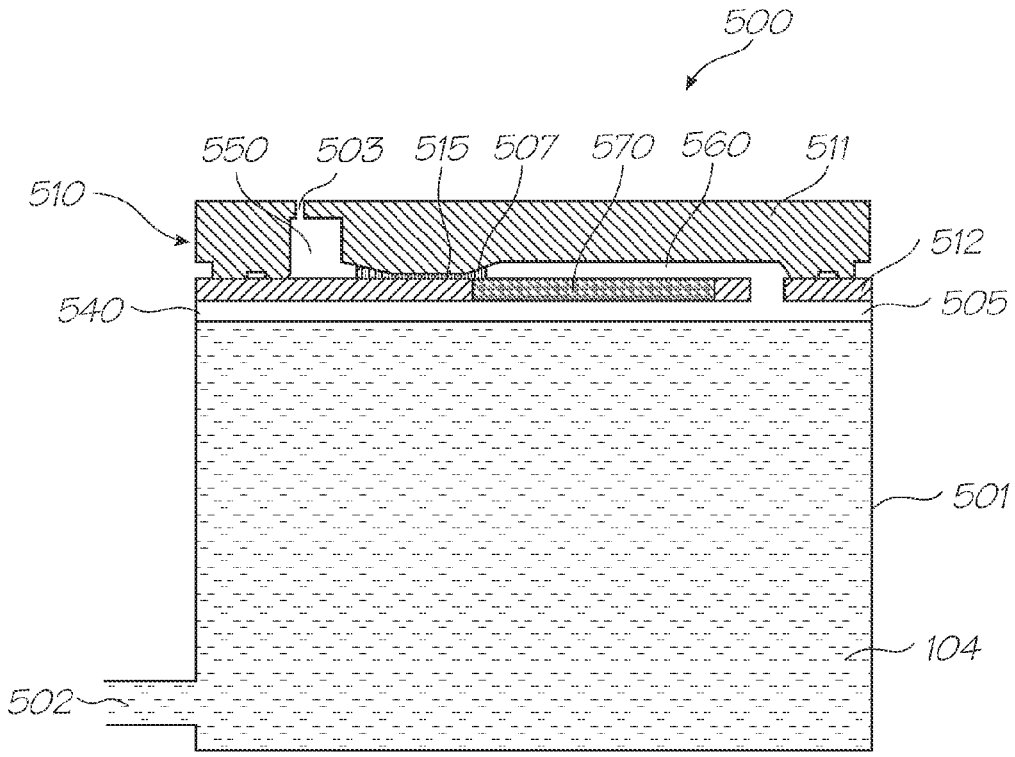
FIG. 20 is a schematic side section of a pressure regulator with a wetting system incorporating a liquid-retaining structure.

Referring now to FIG. 20, there is shown a specific embodiment of a pressure regulator 500 which incorporates a liquid-retaining structure 570. The pressure regulator comprises an ink chamber 501, which contains a reservoir of ink 104, and an ink outlet 502 for supplying ink to a printhead (not shown). Pressure regulation is achieved identically to the pressure regulator 400 described above. Hence, air bubbles having a predetermined Laplace pressure exit from a bubble outlet 507 and vent into a headspace 540 by breaking through a meniscus of ink. In normal use, ink retained by the wetting system (in the form of first and second wetting chambers 550 and 560) and the regulator channel 515 is isolated from the body of ink 104 contained in the chamber 501. Prior to installation in a printer (e.g. during transit), all inlet and outlet ports in the chamber 501 may be plugged to prevent ink leakages.

As shown in FIG. 20, a roof of the ink chamber 501 is defined by a laminated air intake plate 510 comprising first and second planar layers 511 and 512. In the pressure regulator 400 described above, the laminated air intake plate 410 defined a sidewall of the ink chamber 401. However, with the air intake plate 510 defining a roof of the ink chamber 501, the volume of the wetting chambers can be maximized without compromising the volume of ink 104 that can be stored in the ink chamber. Installation in a printer is also facilitated with the air intake plate 510 defining the roof.

The planar layers 511 and 512 of the air intake plate 510 cooperate to define first and second wetting chambers 550 and 560, interconnected by a regulator channel 515. The regulator channel 515 defines a bubble outlet 507 at one end and is therefore critically dimensioned to control the Laplace pressure of air bubbles exiting the bubble outlet.

The first wetting chamber 550 is open to atmosphere via an air inlet 503, whilst the second wetting chamber 560 opens into the headspace 440 of the ink chamber 501 via a vent 505.

The first and second wetting chambers 550 and 560 together retain a constant volume of liquid (typically ink) and function to ensure that the regulator channel 515 remains wetted at all times. It is, of course, crucial that the regulator channel 515 and bubble outlet 507 are never dry when the regulator is required for printing operations, otherwise air can simply stream into the headspace 540 and pressure regulation fails.

Ink is transferable between the first and second wetting chambers 550 and 560 via the regulator channel 515. Hence, a volume of ink retained in each of the first and second wetting chambers 550 and 560 may vary depending on whether the bubble regulator 500 is supplying ink to a connected printhead during printing, or whether the bubble regulator is idle.

By analogy with the pressure regulator 400, it will be appreciated that pressure regulation is achieved in exactly the same manner in the pressure regulator 500. Furthermore, the transfer of ink between wetting chambers 550 and 560 will occur analogously as well. For a detailed explanation of how this transfer of ink occurs, reference is made to FIGS. 16 to 18 and the corresponding description above.

However, whilst the pressure regulator 400 relies solely on tapered sidewalls of the wetting chambers 450 and 460 to retain liquid therein, the pressure regulator 500 has an elongate second wetting chamber 560 which incorporates a liquid-retaining structure 570. This liquid-retaining structure 570 is in fluid communication with liquid in the regulator channel 515 and so provides a reservoir for replenishing any liquid that may be lost from the regulator channel by, for example, evaporation through air inlet 503. Moreover, air bubbles exiting the bubble outlet 507, when ink is supplied through ink outlet 502, are expected to burst within the second wetting chamber 560. The microscopic quantity of ink resulting from burst air bubbles is received by the liquid-retaining structure 570, which extends the length of the second wetting chamber 560. Hence, this ink is captured and recycled to ensure that the regulator channel 515 does not dry out.

The liquid-retaining structure 570 may take many different forms provided that it performs the function of providing a reservoir of liquid in fluid communication with the regulator channel 515. Typically, the structure 570 retains liquid by capillary action.

Figure 21:
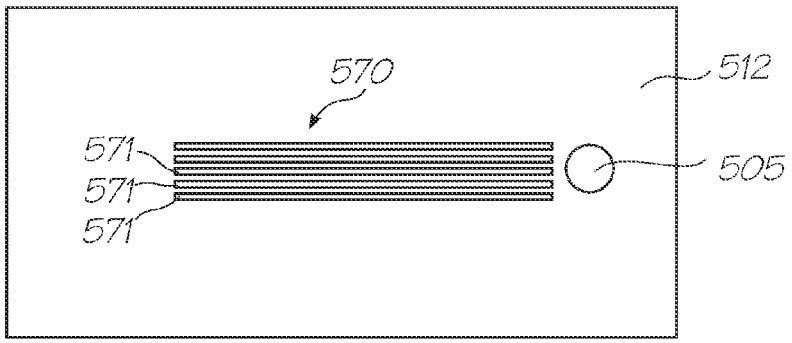
FIG. 21 is a top view of a liquid-retaining structure.
Figure 22:
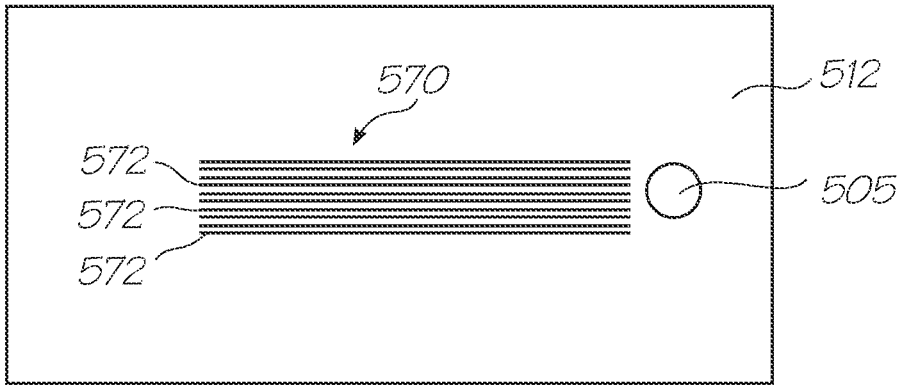
FIG. 22 is a top view of an alternative liquid-retaining structure.
Figure 23:
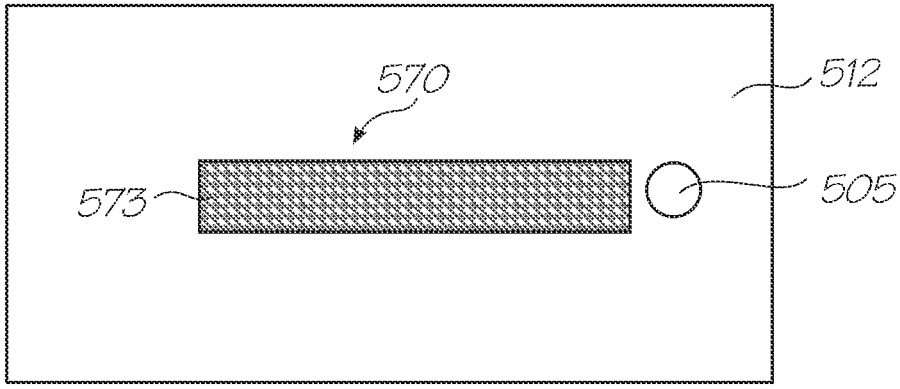
FIG. 23 is a top view of a further alternative liquid-retaining structure.
Figure 24:
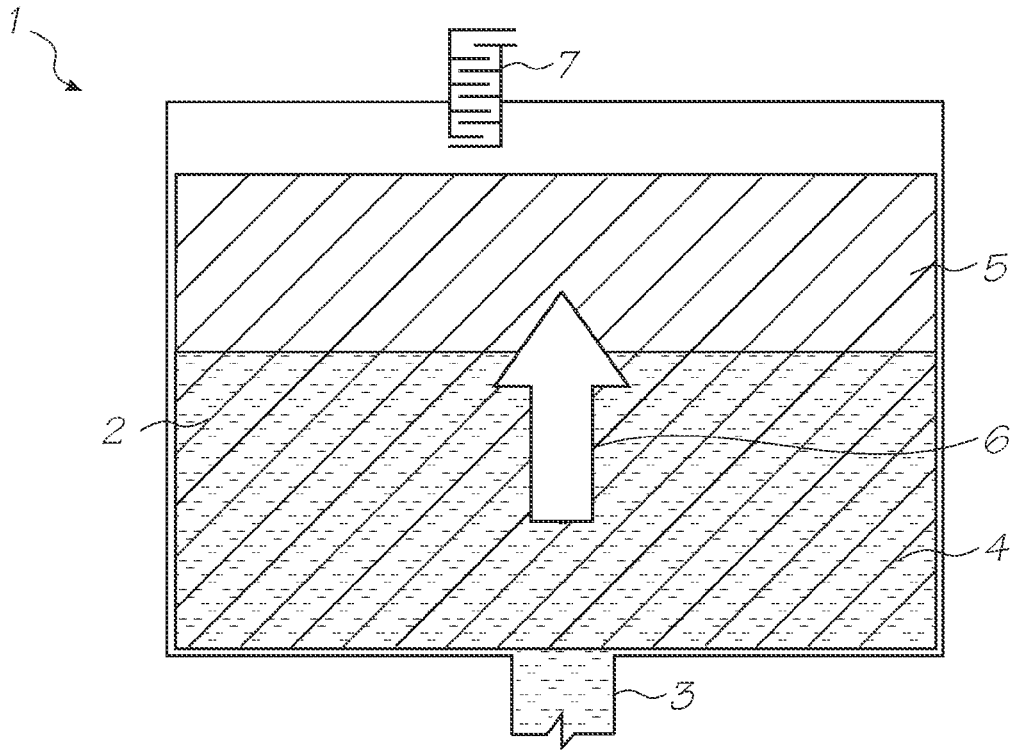
FIG. 24 (PRIOR ART)
FIG. 24 is a schematic side section of a prior art ink cartridge incorporating a foam insert.

FIGS. 21 to 23 are top views of the layer 512, each showing a different form of the liquid-retaining structure 570.

In FIG. 21, the liquid-retaining structure 570 comprises a plurality apertures 571 through the layer 512, which open into the headspace 540 of the ink chamber 501 (see FIG. 20). Each aperture 571 is in the form of an elongate slot having a width dimension sufficiently small to retain liquid by capillary action. Trapped liquid in these slots 571 communicates with the regulator channel 515.

In FIG. 22, the liquid-retaining structure 570 comprises a plurality of recesses or grooves 572 defined in a surface of the layer 512. Each groove 572 retains liquid by capillary action and communicates with the regulator channel 515.

In FIG. 23, the liquid-retaining structure 570 comprises a sponge 573, which retains liquid by capillary action. The sponge may be positioned in a complementary recess of the layer 512; alternatively, the sponge 573 may be supported in a complementary slot defined in the layer 512 so that one surface of the sponge 573 is in contact with the headspace 540. An advantage of this latter arrangement is that the sponge 573 can trap saturated ink vapour in the headspace 540 and, hence, minimizes the likelihood of the sponge drying out. The sponge 573 can also absorb ink when the chamber 501 is tipped, such as occurs during transport. Likewise, the slots 571 described above, which open into the headspace 540, perform the same function.

The skilled person will be able to envisage other forms of liquid-retaining structure 570 that retain liquid by capillary action. Essentially, any structure with curved features may be suitable.

Due to the simplicity and low-cost manufacture of the pressure regulator 500, it may be constructed as a replaceable ink cartridge for an inkjet printer. Hence, each time the ink cartridge is replaced, the pressure regulator is replaced. An advantage of this design is that long-term fouling of the pressure regulator 500 is avoided, because it is periodically replaced during the lifetime of the printer.

It will, of course, be appreciated that the present invention has been described purely by way of example and that modifications of detail may be made within the scope of the invention, which is defined by the accompanying claims.

The invention claimed is:

1. An ink pressure regulator for regulating a hydrostatic pressure of ink supplied to an inkjet printhead, said regulator comprising:

an ink chamber having an ink outlet for fluid communication with the printhead via an ink line, wherein a roof of the ink chamber comprises:

an air inlet;

a regulator channel having a first end communicating with the air inlet and a second end communicating with a headspace of the chamber, said second end defining a bubble outlet; and a liquid-retaining structure in fluid communication with the regulator channel, said liquid-retaining structure being positioned and configured for capturing ink from the headspace of the ink chamber, wherein said regulator channel is dimensioned to regulate a hydrostatic pressure of ink supplied to the printhead; and wherein said regulator is positioned between first and second wetting chambers, and wherein said liquid-retaining structure defines a wall of at least one of said wetting chambers.

2. The ink pressure regulator of claim 1, wherein said liquid-retaining structure is configured such that liquid from burst air bubbles is captured by said liquid-retaining structure.

3. The ink pressure regulator of claim 1, wherein said first wetting chamber define the air inlet and said second wetting chamber defines a vent opening into the headspace of the ink chamber.

4. The ink pressure regulator of claim 3, wherein said second wetting chamber is elongate and said liquid-retaining structure extends along a length of said second wetting chamber.

5. The ink pressure regulator of claim 4, wherein said liquid-retaining structure is defined by one or more liquid-retaining apertures defined in a wall of said second wetting chamber, said liquid-retaining apertures opening into said headspace.

6. The ink pressure regulator of claim 4, wherein said liquid-retaining structure is defined by a plurality of slots defined in said wall of said second wetting chamber.

7. The ink pressure regulator of claim 4, wherein said liquid-retaining structure is a sponge.

8. The ink pressure regulator of claim 4, wherein said liquid-retaining structure comprises one or more liquid-retaining grooves defined in a wall of said second wetting chamber.

9. The ink pressure regulator of claim 1, wherein said liquid-retaining structure retains said liquid by capillary action.

10. The ink pressure regulator of claim 1, wherein said pressure regulator defines an ink cartridge for an inkjet printer.

* * * * *